US007434288B2

(12) United States Patent
Gavney, Jr.

(10) Patent No.: US 7,434,288 B2
(45) Date of Patent: Oct. 14, 2008

(54) ORAL CARE DEVICE WITH MULTI-STRUCTURAL CONTACT ELEMENTS

(76) Inventor: James A. Gavney, Jr., 996 Amarillo, Palo Alto, CA (US) 94303

( * ) Notice: Subject to any disclaimer, the term of this patent is extended or adjusted under 35 U.S.C. 154(b) by 852 days.

(21) Appl. No.: 10/925,582

(22) Filed: Aug. 24, 2004

(65) Prior Publication Data

US 2005/0015904 A1 Jan. 27, 2005

Related U.S. Application Data

(63) Continuation-in-part of application No. 09/957,302, filed on Sep. 19, 2001, now Pat. No. 6,865,767.

(60) Provisional application No. 60/233,580, filed on Sep. 19, 2000.

(51) Int. Cl.
*A46B 9/02* (2006.01)
*A46B 9/04* (2006.01)
*A47L 13/12* (2006.01)

(52) U.S. Cl. ..... 15/117; 15/114; 15/110

(58) Field of Classification Search ..... 15/167.1, 15/167.2, 106, 107, 110, 114, 117, 121, 160, 15/188, 201, 245; 601/137, 138, 139; 433/141, 433/216

See application file for complete search history.

(56) References Cited

U.S. PATENT DOCUMENTS

| | | | |
|---|---|---|---|
| 34,109 | A | 1/1862 | Fenshaw et al. |
| 116,030 | A | 6/1871 | Devines |
| 116,346 | A | 6/1871 | O'Brian |
| 218,431 | A | 8/1879 | Dunham |
| 411,910 | A | 10/1889 | Van Horne |
| 620,151 | A | 3/1899 | Emsa-Works et al. |
| 742,639 | A | 10/1903 | Harlan |
| 907,842 | A | 12/1908 | Meuzies |
| 915,251 | A | 3/1909 | Vanderslice |
| 1,006,630 | A | 10/1911 | Clarke |
| 1,128,139 | A | 2/1915 | Hoffman |
| 1,142,698 | A | 6/1915 | Grove et al. |
| 1,188,823 | A | 6/1916 | Plank |
| 1,191,556 | A | 7/1916 | Blake |
| 1,268,544 | A | 6/1918 | Cates |
| 1,297,272 | A | 3/1919 | Strang et al. |
| 1,405,279 | A | 1/1922 | Cassedy |
| 1,500,274 | A | 7/1924 | Scarling |
| 1,526,267 | A | 2/1925 | Dessau |
| 1,578,074 | A | 2/1926 | Chandler |
| 1,588,785 | A | 6/1926 | Van Sant |
| 1,598,224 | A | 8/1926 | Van Sant |

(Continued)

FOREIGN PATENT DOCUMENTS

| | | |
|---|---|---|
| DE | 31 14 507 A1 | 3/1983 |

(Continued)

*Primary Examiner*—David B Thomas
(74) *Attorney, Agent, or Firm*—Jag Patent Services LLC

(57) ABSTRACT

A contact device with resilient contact elements is disclosed. The resilient contact elements have primary structures and secondary structures. The primary structures and secondary structures have contact surfaces for engaging a working surface. The primary structures are preferably molded structures with hardness value between 10 to 90 Shores A. The secondary structures are nodules, squeegees, arrays of nodules or squeegees and matrices but are preferably bristle structures formed from plastic resins, wherein the device is configured clean dentition.

25 Claims, 19 Drawing Sheets

U.S. PATENT DOCUMENTS

| | | | | | |
|---|---|---|---|---|---|
| 1,705,249 | A | | 3/1929 | Henry | |
| 1,707,118 | A | | 3/1929 | Goldberg | |
| 1,720,017 | A | | 7/1929 | Touchstone | |
| 1,766,529 | A | | 6/1930 | Peirson | |
| 1,833,555 | A | | 11/1931 | Bell et al. | |
| 1,852,480 | A | | 4/1932 | Ruetz | |
| 1,868,893 | A | | 7/1932 | Gentle | |
| 1,910,414 | A | | 5/1933 | Varga | |
| 1,924,152 | A | | 8/1933 | Coney et al. | 15/167 |
| 1,965,009 | A | | 7/1934 | Stevens | 15/188 |
| 1,993,662 | A | | 3/1935 | Green | 15/110 |
| 2,008,636 | A | | 7/1935 | Brynan | 91/67.4 |
| 2,059,914 | A | | 11/1936 | Rosenberg | 15/110 |
| 2,088,839 | A | | 8/1937 | Coney et al. | 15/188 |
| 2,117,174 | A | | 5/1938 | Jones | 15/110 |
| 2,129,082 | A | | 9/1938 | Byrer | 128/62 |
| 2,129,245 | A | | 12/1938 | Ogden | 128/62 |
| 2,154,846 | A | | 4/1939 | Heymann et al. | 128/62 |
| 2,219,753 | A | | 10/1940 | Sequin | 15/188 |
| 2,226,145 | A | | 12/1940 | Smith | 15/29 |
| 2,244,699 | A | | 6/1941 | Hosey | 15/188 |
| 2,279,355 | A | | 4/1942 | Wilensky | 15/110 |
| 2,312,828 | A | | 3/1943 | Adamsson | 15/167 |
| 2,321,333 | A | | 6/1943 | Terry | 15/135 |
| 2,334,796 | A | | 11/1943 | Steinmetz et al. | 15/121 |
| 2,443,461 | A | | 6/1948 | Kempster | 15/188 |
| 2,516,491 | A | | 7/1950 | Swastek | 15/188 |
| 2,518,765 | A | | 8/1950 | Ecker | 15/115 |
| 2,534,086 | A | | 12/1950 | Vosbikian et al. | 15/245 |
| 2,545,814 | A | | 3/1951 | Kempster | 15/188 |
| 2,637,870 | A | | 5/1953 | Cohen | 15/188 |
| 2,702,914 | A | | 3/1955 | Kittle et al. | 15/114 |
| 2,757,668 | A | | 8/1956 | Meyer-Saladin | 128/173.1 |
| 2,815,601 | A | | 12/1957 | Hough, Jr. | 41/5.5 |
| 2,884,151 | A | | 4/1959 | Biederman | 215/41 |
| 3,103,027 | A | | 9/1963 | Birch | 15/110 |
| 3,110,052 | A | | 11/1963 | Whitman | 15/117 |
| 3,133,546 | A | | 5/1964 | Dent | 132/120 |
| 3,181,193 | A | | 5/1965 | Nobles et al. | 15/114 |
| 3,195,537 | A | | 7/1965 | Blasi | 128/56 |
| 3,230,562 | A | | 1/1966 | Birch | 15/110 |
| 3,231,925 | A | | 2/1966 | Conder | 15/605 |
| 3,261,354 | A | | 7/1966 | Shpuntoff | 128/173 |
| 3,359,588 | A | | 12/1967 | Kobler | 15/110 |
| 3,491,396 | A | | 1/1970 | Eannarino et al. | 15/104.94 |
| 3,553,759 | A | | 1/1971 | Kramer et al. | 15/110 |
| 3,563,233 | A | | 2/1971 | Bodine | 128/36 |
| 3,570,726 | A | | 3/1971 | Pomodoro | 222/546 |
| 3,641,610 | A | | 2/1972 | Lewis, Jr. | 15/114 |
| 3,769,652 | A | * | 11/1973 | Rainer | 15/167.2 |
| 3,939,522 | A | | 2/1976 | Shimizu | 15/244 R |
| 3,969,783 | A | | 7/1976 | Shipman | 15/250.04 |
| 3,977,084 | A | | 8/1976 | Sloan | 32/59 |
| 3,992,747 | A | | 11/1976 | Hufton | 15/321 |
| 4,011,616 | A | * | 3/1977 | Kennedy | 15/21.1 |
| 4,090,647 | A | | 5/1978 | Dunning | 222/543 |
| 4,115,893 | A | | 9/1978 | Nakata et al. | 15/110 |
| 4,128,910 | A | | 12/1978 | Nakata et al. | 15/110 |
| 4,167,794 | A | | 9/1979 | Pomeroy | 15/188 |
| 4,277,862 | A | | 7/1981 | Weideman | 15/110 |
| 4,428,091 | A | | 1/1984 | Janssen | 15/167 A |
| 4,573,920 | A | | 3/1986 | d'Argembeau | 433/141 |
| 4,585,416 | A | | 4/1986 | DeNiro et al. | 433/140 |
| 4,610,043 | A | | 9/1986 | Vezjak | 15/111 |
| 4,691,405 | A | | 9/1987 | Reed | 15/201 |
| 4,763,380 | A | | 8/1988 | Sandvick | 15/160 |
| 4,812,070 | A | | 3/1989 | Marty | 401/289 |
| 4,827,551 | A | | 5/1989 | Maser et al. | 15/24 |
| 4,866,805 | A | * | 9/1989 | Oden et al. | 15/104.92 |
| 4,866,806 | A | | 9/1989 | Bedford | 15/104.94 |
| 4,887,924 | A | | 12/1989 | Green | 401/261 |
| 4,913,133 | A | | 4/1990 | Tichy | 128/62 |
| 4,929,180 | A | | 5/1990 | Moreschini | 433/166 |
| 5,005,246 | A | | 4/1991 | Yen-Hui | 15/111 |
| 5,032,082 | A | | 7/1991 | Herrera | 433/141 |
| 5,040,260 | A | | 8/1991 | Michaels | 15/137.1 |
| D326,019 | S | | 5/1992 | Spangler et al. | D4/118 |
| 5,211,494 | A | | 5/1993 | Baijnath | 401/28 |
| 5,226,197 | A | | 7/1993 | Nack et al. | 15/111 |
| 5,249,327 | A | | 10/1993 | Hing | 15/104.94 |
| 5,283,921 | A | | 2/1994 | Ng | 15/22.1 |
| 5,289,605 | A | | 3/1994 | Armbruster | 15/97.1 |
| 5,335,389 | A | | 8/1994 | Curtis et al. | 15/167.1 |
| 5,341,537 | A | | 8/1994 | Curtis et al. | 15/167.1 |
| 5,345,641 | A | * | 9/1994 | Webster | 15/105 |
| 5,360,084 | A | * | 11/1994 | Graf | 184/3.2 |
| 5,491,863 | A | | 2/1996 | Dunn | 15/106 |
| 5,528,793 | A | | 6/1996 | Schbot | 15/245 |
| 5,535,474 | A | | 7/1996 | Salazar | 15/100 |
| 5,584,690 | A | | 12/1996 | Maassarani | 433/125 |
| 5,604,951 | A | | 2/1997 | Shipp | 15/167.1 |
| 5,628,082 | A | | 5/1997 | Moskovich | 15/110 |
| 5,669,097 | A | | 9/1997 | Klinkhammer | 15/167.1 |
| 5,711,759 | A | | 1/1998 | Smith et al. | 601/139 |
| 5,729,858 | A | * | 3/1998 | Riffel | 15/111 |
| 5,735,011 | A | | 4/1998 | Asher | 15/167.1 |
| 5,799,353 | A | | 9/1998 | Oishi et al. | 15/167.1 |
| 5,802,656 | A | | 9/1998 | Dawson et al. | 15/110 |
| 5,806,127 | A | | 9/1998 | Samoil et al. | 15/104.94 |
| 5,810,856 | A | | 9/1998 | Tveras | 606/161 |
| D402,116 | S | | 12/1998 | Magloff et al. | D4/104 |
| D403,510 | S | | 1/1999 | Menke et al. | D4/104 |
| 5,896,614 | A | | 4/1999 | Flewitt | 15/167.1 |
| 5,930,860 | A | | 8/1999 | Shipp | 15/110 |
| 5,966,771 | A | | 10/1999 | Stroud | 15/117 |
| 5,970,564 | A | | 10/1999 | Inns et al. | 15/201 |
| 5,980,542 | A | | 11/1999 | Saldivar | 606/161 |
| 5,991,959 | A | | 11/1999 | Raven et al. | 15/201 |
| 6,021,541 | A | | 2/2000 | Mori et al. | 15/167.1 |
| 6,032,322 | A | | 3/2000 | Forsline | 15/245.1 |
| 6,041,467 | A | | 3/2000 | Roberts et al. | 15/167.1 |
| D422,143 | S | | 4/2000 | Beals et al. | D4/104 |
| 6,044,514 | A | | 4/2000 | Kaneda et al. | 15/167.1 |
| D424,808 | S | | 5/2000 | Beals et al. | D4/104 |
| D425,306 | S | | 5/2000 | Beals et al. | D4/104 |
| 6,065,890 | A | | 5/2000 | Weitz | 401/146 |
| 6,067,684 | A | | 5/2000 | Kweon | 15/167.1 |
| 6,077,360 | A | | 6/2000 | Takashima | 134/6 |
| 6,088,869 | A | | 7/2000 | Kaneda et al. | 15/167.1 |
| 6,099,309 | A | | 8/2000 | Cardarelli | 433/125 |
| 6,108,854 | A | | 8/2000 | Dingert | 15/188 |
| 6,115,871 | A | | 9/2000 | Royer | 15/167.2 |
| 6,126,533 | A | | 10/2000 | Johnson et al. | 451/527 |
| 6,151,745 | A | | 11/2000 | Roberts et al. | 15/167.1 |
| 6,151,746 | A | | 11/2000 | Lewis, Jr. | 15/187 |
| 6,168,434 | B1 | | 1/2001 | Bohm-Van Diggelen | 433/141 |
| 6,182,323 | B1 | | 2/2001 | Bahten | 12/230.16 |
| 6,182,365 | B1 | | 2/2001 | Tseng et al. | 30/34.2 |
| 6,190,367 | B1 | | 2/2001 | Hall | 604/290 |
| 6,219,874 | B1 | | 4/2001 | van Gelder et al. | 15/167.1 |
| 6,240,590 | B1 | | 6/2001 | Nesbit | 15/210.1 |
| 6,245,032 | B1 | | 6/2001 | Sauer et al. | 601/162 |
| 6,254,390 | B1 | | 7/2001 | Wagner | 433/216 |
| 6,272,713 | B1 | | 8/2001 | Lotwin | 15/104.061 |
| 6,276,021 | B1 | | 8/2001 | Hohlbein | 15/167.1 |
| 6,299,508 | B1 | | 10/2001 | Gagliardi et al. | 451/28 |
| 6,311,360 | B1 | | 11/2001 | Lanvers | 15/191.1 |
| 6,319,332 | B1 | | 11/2001 | Gavney, Jr. et al. | 134/6 |
| 6,421,867 | B1 | | 7/2002 | Weihrauch | 15/28 |
| 6,446,295 | B1 | | 9/2002 | Calabrese | 15/28 |
| 6,463,619 | B2 | | 10/2002 | Gavney, Jr. | 15/117 |
| 6,510,575 | B2 | | 1/2003 | Calabrese | 15/22.1 |
| 6,513,182 | B1 | | 2/2003 | Calabrese et al. | 15/110 |
| 6,557,203 | B2 | * | 5/2003 | Meshbesher | 15/104.92 |

| | | | | |
|---|---|---|---|---|
| 6,571,417 | B1 | 6/2003 | Gavney, Jr. et al. | 15/117 |
| 6,584,636 | B2 * | 7/2003 | Schlem | 15/104.92 |
| 6,647,585 | B1 | 11/2003 | Robinson | 15/322 |
| D483,184 | S | 12/2003 | Geiberger et al. | D4/104 |
| 6,658,688 | B2 | 12/2003 | Gavney, Jr. | 15/117 |
| 6,658,692 | B2 | 12/2003 | Lenkiewicz et al. | 15/320 |
| 6,668,418 | B2 | 12/2003 | Bastien | 15/245 |
| 6,725,493 | B2 | 4/2004 | Calabrese et al. | 15/110 |
| 6,813,793 | B2 | 11/2004 | Eliav et al. | 15/22.2 |
| 6,820,299 | B2 | 11/2004 | Gavney, Jr. | 15/117 |
| 6,820,300 | B2 | 11/2004 | Gavney, Jr. | 15/117 |
| 6,865,767 | B1 * | 3/2005 | Gavney, Jr. | 15/114 |
| 6,983,507 | B2 * | 1/2006 | McDougall | 15/22.1 |
| 2001/0039689 | A1 | 11/2001 | Gavney, Jr. | 15/117 |
| 2002/0124337 | A1 | 9/2002 | Calabrese et al. | 15/117 |
| 2003/0033680 | A1 | 2/2003 | Davies et al. | 15/22.1 |
| 2003/0033682 | A1 | 2/2003 | Davies et al. | 15/110 |
| 2003/0196283 | A1 | 10/2003 | Eliav et al. | 15/22.1 |
| 2004/0010869 | A1 | 1/2004 | Fattori et al. | 15/22.1 |
| 2004/0045105 | A1 | 3/2004 | Eliav et al. | 15/22.1 |
| 2004/0060132 | A1 | 4/2004 | Gatzemeyer et al. | 15/22.1 |
| 2004/0060133 | A1 | 4/2004 | Eliav et al. | 15/22.1 |
| 2004/0060135 | A1 | 4/2004 | Gatzemeyer et al. | 15/22.1 |
| 2004/0060136 | A1 | 4/2004 | Gatzemeyer et al. | 15/22.1 |
| 2004/0060137 | A1 | 4/2004 | Eliav | 15/22.1 |
| 2004/0154112 | A1 | 8/2004 | Braun et al. | 15/22.1 |
| 2004/0200016 | A1 | 10/2004 | Chan et al. | 15/22.1 |
| 2005/0000048 | A1 | 1/2005 | Hohlbein | 15/110 |
| 2005/0060826 | A1 * | 3/2005 | Gavney, Jr. | 15/117 |

FOREIGN PATENT DOCUMENTS

| | | | |
|---|---|---|---|
| DE | 298 16 488 | U1 | 1/1999 |
| DE | 199 57 639 | A1 | 6/2001 |
| FR | 2 636 818 | | 3/1990 |
| FR | 2 793 136 | | 11/2000 |
| GB | 290515 | | 5/1928 |
| GB | 305735 | | 2/1929 |
| GB | 2 040 161 | A | 8/1980 |
| JP | 9-140456 | | 3/1997 |
| WO | WO 96/28994 | | 9/1996 |
| WO | WO 96/20654 | | 11/1996 |
| WO | WO 98/22000 | | 5/1998 |
| WO | WO 98/18364 | | 7/1998 |
| WO | WO 01/01817 | A1 | 1/2001 |
| WO | WO 01/21036 | A1 | 3/2001 |
| WO | WO 03/030680 | A1 | 4/2003 |
| WO | WO 03/043459 | A2 | 5/2003 |
| WO | WO 2004/041023 | A2 | 5/2004 |
| WO | WO 2004/064573 | A1 | 8/2004 |

* cited by examiner

ORAL CARE DEVICE WITH MULTI-STRUCTURAL CONTACT ELEMENTS

RELATED APPLICATIONS

This Patent Application is a continuation in part Application of U.S. patent application Ser. No. 09/957,302, filed Sep. 19, 2001, and titled "APPARATUS WITH MULTI-STRUCTURAL CONTACT ELEMENTS", now U.S. Pat. No. 6,865,767. The U.S. patent application Ser. No. 09/957,302, filed Sep. 19, 2001, and titled "APPARATUS WITH MULTI-STRUCTURAL CONTACT ELEMENTS" claims under 35 U.S.C. § 119(e) from the co-pending U.S. Provisional Patent Application, Ser. No. 60/233,580, filed Sep. 19, 2000, and titled "APPARATUS WITH MULTI-STRUCTURAL CONTACT ELEMENTS". The U.S. patent application Ser. No. 09/957,302, filed Sep. 19, 2001, and titled "APPARATUS WITH MULTI-STRUCTURAL CONTACT ELEMENTS" and the Provisional Patent Application Ser. No. 60/233,580, filed Sep. 19, 2000, and titled "APPARATUS WITH MULTI-STRUCTURAL CONTACT ELEMENTS" are both hereby incorporated by reference.

FIELD OF THE INVENTION

This invention relates generally to devices with contact elements. More specifically, the invention relates to devices with resilient contact elements.

BACKGROUND OF THE INVENTION

Devices with resilient contact elements are typically used to clean surfaces or to apply cleaners and other materials to surfaces. For example, brush devices have bristle contact elements. The bristles are provided in the appropriate configuration and are chosen with the appropriate geometry, flexibility, hardness and resiliency to suit the intended purpose. As one example of these devices, a paintbrush is typically configured with long flexible bristles that conform to surfaces and facilitate the application of paints to surfaces. Other brush devices are configured with short rigid bristles to scour, scrub or clean surfaces.

Sponges and other absorbent materials are also used as resilient contact elements. Sponges and related materials are typically soft and used in cleaning devices and applicator devices.

Squeegees are also used in contact devices. Because squeegees are often made from non-absorbent materials, such as rubber, they are not generally used in applicator devices. Squeegees are flexible and resilient and tend to be too soft to be used in scrubbing or scouring devices. Squeegees are most commonly used to wipe or squeegee water and water solutions from smooth glass surfaces.

There have been attempts to combine the cleaning properties of an absorbent sponge-like element with a squeegee element. In the U.S. Pat. No. 6,065,890 issued to Weitz, Weitz describes a cleaning device with a squeegee element and a sponge element attached to a yoke support for combining washing and wiping.

Devices with brush-like contact elements molded form non-absorbent rubber-like materials have also been described. For example, in the U.S. Pat. No. 5,966,771, issued to Stroud, Stroud describes a polymeric sweeping device that is formed from a polymeric head with a soft polymeric bristle portion. In the U.S. Pat. No. 6,032,322, issued to Florsline, Florsline describes a device with a silicone tip configured to be used as a paint applicator or an artist's tool.

Molded rubber-like or resilient contact elements have also been described in dentition cleaning and oral care devices. In the U.S. Pat. No. 5,032,082 issued to Herrera, Herrera describes a device for removing adhesives from a palate. The device is configured with a plurality of rubber nodules having resiliencies that are sensitive to temperature. Tveras, in the U.S. Pat. No. 5,810,556, discloses an oral hygiene device configured with a plurality of wiping elements at one end of the device and a brush section at the other end; the wiping elements are configured for scraping plaque from a tongue. In the U.S. Pat. No. 6,067,684, issued to Kweon, Kweon describes a toothbrush with silicone rubber bristles. The silicone bristles are plate-shaped bristles extending in a parallel arrangement along the sides of the cleaning head. The cleaning head is attached to a handle through a hole in the handle. In the U.S. Pat. No. 4,584,416, issued to DeNiro et al., DeNiro et al. describe a resilient chewing device for cleaning teeth and gums. The device is a spool-shaped member formed of a resilient material. The interior regions of the spool-shaped member have protrusions to facilitate the cleaning of gums and teeth when a user chews on the device. The U.S. Pat. No. 5,970,564, issued to Inns et al., describes bristle sections that are coupled through an elastomeric bridge. The elastomeric bridge provides for the ability to anchor sets of bristles that are attached to a flexible platform. Mori et al., in U.S. Pat. No. 6,021,541, describe a toothbrush with composite monofiliment fibers. The composite monofiliment fibers have a polyester sheath with 2-5 polyamide cores. The polyamide cores protrude from the composite cores by a predetermined distance.

SUMMARY

The current invention is directed to a device with at least one resilient contact element. The device of the present invention is configured for applying materials to a surface, cleaning a surface, texturing materials or massaging tissues. The contact element has a least two structures. For this description and for simplicity of understanding, the invention is described in terms of primary and secondary structures. Primary structures refer to structures that protrude from a supporting non-contact structure or portion thereof, such as a handle or a cleaning head. Secondary structures refer to structures that are coupled to primary structures such that the secondary structures exhibit cooperative displacement with the primary structure. Preferably, both the primary and the secondary structure contribute to the contact properties of the contact elements.

The primary structure and the secondary structure are made of the same material or of different materials. The primary structure and the secondary structure are formed in multiple steps, as a monolithic element, or in parts that are later attached together. A device in accordance with the instant invention is configured with any number contact elements depending on the intended use. Further, it is understood that contact elements and the corresponding supporting structure or structures of the device are monolithic or formed in parts.

The primary and secondary structures are preferably formed from resilient materials such as plastics, elastomers, rubber or rubber-like materials. However, in an embodiment of the instant invention the secondary structure comprises metal bristles. The primary and the secondary structures are, nodule structures, arrays of nodules, squeegee structures, squeegee matrix structures, bristles and combinations thereof. The contact surfaces provided by the device of the present invention are configured to be collectively planar, curved or three-dimensional. The primary structure preferably protrudes from a support structure by a distance in a range of 0.2 to 6.0 mm. The maximum thickness of any nodule protrusion, squeegee wall, or matrix wall is preferably not greater that 2.0 mm and is more preferably less than 1.0 mm and greater than 0.3 mm. However, it is clear that contact devices with contact elements of larger dimensions than the preferred dimensions, recited herein, can have industrial applications.

The primary structure provides first contact surfaces and the secondary structure provides second contact surfaces. Preferably, the primary structure is molded and is larger than the secondary structure, wherein the secondary structure protrudes from a surface portion of the primary structure. Accordingly, the secondary structure exhibits cooperative displacement, wherein displacing the primary structure from its equilibrium resting position will also displace the secondary structure. Depending on the geometries of the structures and the materials used to make the contact elements, the primary structure may also exhibit cooperative displacement with the secondary structure.

According to an embodiment of the instant invention, the primary and secondary structures of a contact element are configured such that only the contact surfaces of either the primary or secondary structure will engage a working surface when a first force is applied to a working surface through the primary structure. By applying a sufficiently greater force to the working surface through the primary structure, the contact surfaces of the secondary and primary structure engage the working surface. Accordingly, multiple types of contact surfaces are provided within a single multi-structural contact element or device. Further, applying more or less force to the working surface through the contact element controls the types contact surfaces that engage the working surface.

According to another embodiment of the instant invention, the primary structure is more flexible than the secondary structure. The primary structure provides a cushion for the second structure. Thus the force that is required to deform the primary structure limits the force that may be applied to a working surface through the contact element or elements.

According to yet another embodiment of the instant invention a device is configured with a contact element having a primary structure and a secondary structure capable of engaging a working surface concurrently through out an entire range of forces as applied to a working surface through the contact element.

In accordance with a preferred embodiment of the invention, the device is a dentition cleaning device. According to this preferred embodiment, the contact element has a plurality of nodules or squeegee protrusions with bristle attached thereto. The primary structure preferably has a hardness in a range of 10 to 90 Shores A as determined by a method described in Document ASTM D2240-00, Developed by the American Society for Testing Materials, entitled "Standard Test Method for Rubber Property-Durometer Hardness", the contents of which are hereby incorporated by reference. The secondary structure includes bristles or sections of bristles formed from polyester, polyamide or any other suitable resin for forming fibers.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

To facilitate the clarity of the ensuing description, words listed below have been ascribed the following meanings:

1) A nodule is a protruding structure with outer surfaces.
2) A squeegee is an elongated and protruding structure, i.e. a nodule that is on the average thinner in one dimension that the other, the wider dimension being referred to herein as the elongation direction.
3) An array is a grouping of protruding structures.
4) A matrix is a protruding structure that has an extended network of edges, walls and cavities.
5) Softness is the ease with which the surface of a structure yields or deforms to an applied force.
6) Hardness is the magnitude of force required for a structure to yield or deform to an applied force as measured with durometer hardness meter and reported in units of Shore A.
7) Resiliency is the ability of a structure to return substantially to its original form or geometry after a deformation to the structure or portion thereof. Structures that substantially return to their original form or geometry quickly after a deformation are described herein, as being more resilient than those structures, which substantially return to their original form or geometry slowly after a deformation.
8) Resilient materials are materials that exhibit resiliency.
9) Flexibility is a measure of the ability of a resilient structure or a measure of the ability of a resilient structure to be displaced from an equilibrium rest position without damage to the structure. A structure that is less flexible is more rigid.

Figure 1A:
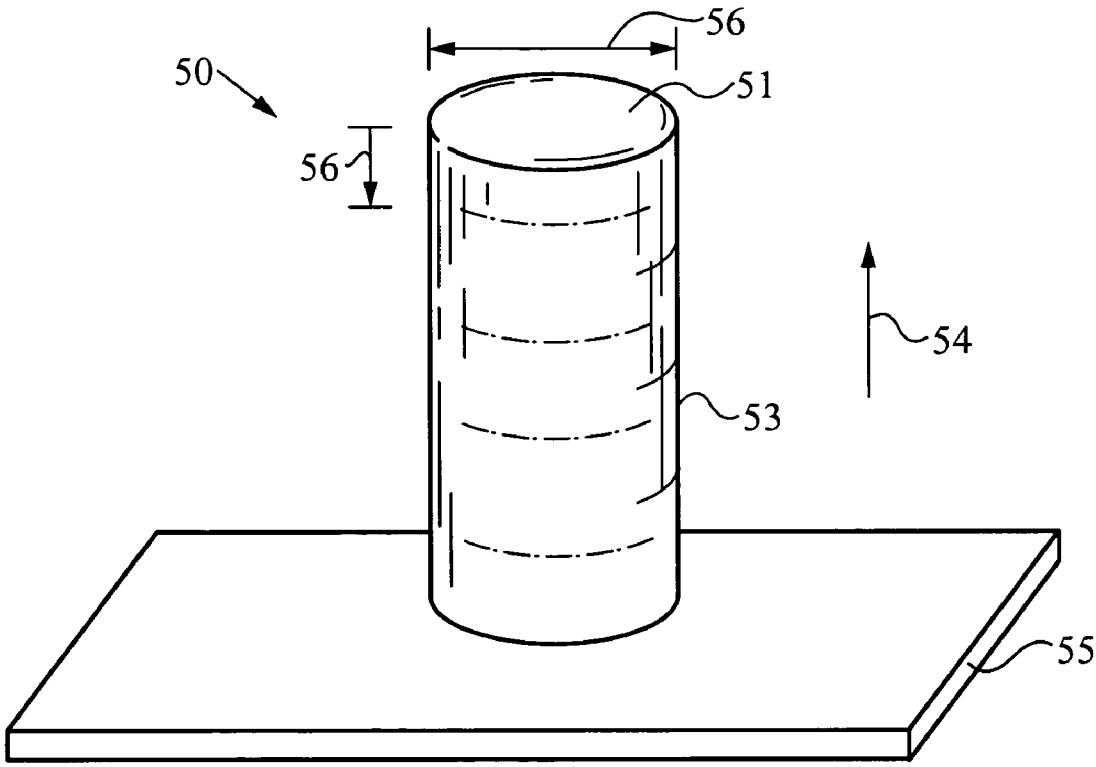
FIG. 1*a* shows an exemplary nodule structure.

FIG. 1*a* shows a typical nodule structure 50. The nodule structure protrudes from support surfaces 55 in a protruding direction 54 and preferably extends to distances in a range of 0.2 to 6.0 mm from the support surfaces 55. The nodule 53 has wall surfaces and tip surfaces 51. Preferably, the averaged thickness 56 of the nodule 50 is not greater than 2.0 mm and is most preferably less than 1.0 mm measured from distances 57 between the tip 51 of the structure 50 and 0.2 mm down from the tip 51 of the structure 50.

Figure 1B:
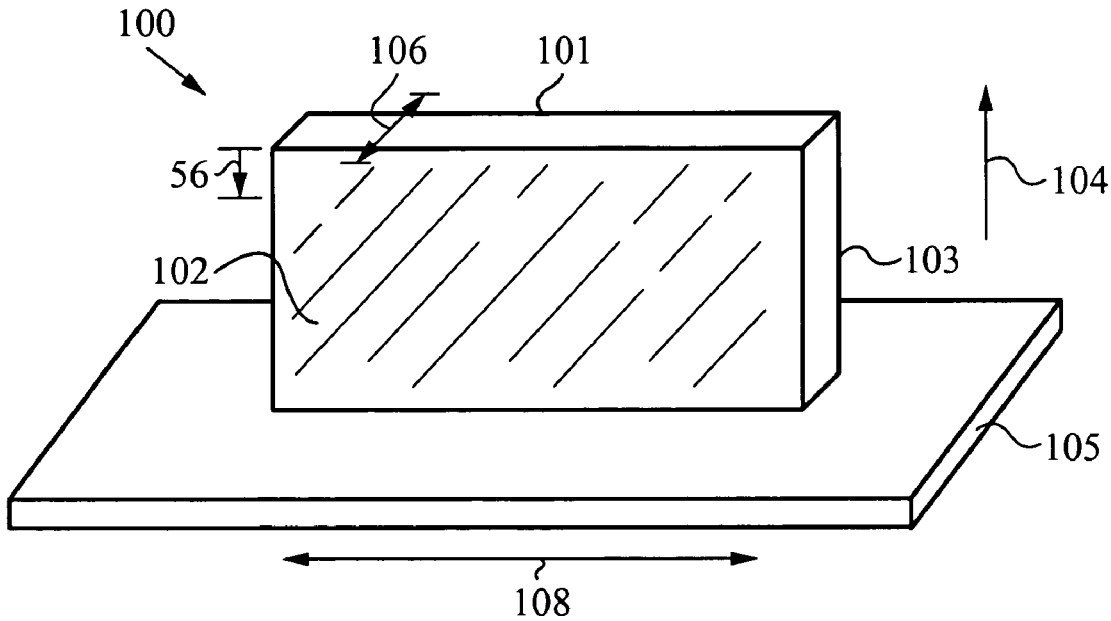
FIG. 1*b* show an exemplary squeegee structure.

FIG. 1*b* shows a section of a squeegee structure 100. The squeegee structure 100 protrudes from support surfaces 105 in a protruding direction 104 and preferably extends to distances in a range of 0.2 to 6.0 mm. The squeegee structure 100 has squeegee wall surfaces 102, squeegee edge surfaces 101 and squeegee ends 103 and 103'. According to the current invention, squeegee structures extend in the elongation direction 108 to any distance and takes on any number of shapes and forms. Squeegee structure herein refers to an elongated structure with two ends as shown in FIG. 1*b*, an elongated structure with one end, an elongated structure without ends (viz. a continuos squeegee structure) and combinations thereof. Preferably, the averaged thickness 106 of the squeegee wall 102 is not greater than 2.0 mm and is most preferably less than 1.0 mm measured distances 107 between the edge surfaces 101 of the structure 100 and 0.2 mm down from the edge surfaces 101 of the structure 100.

Figure 1C:
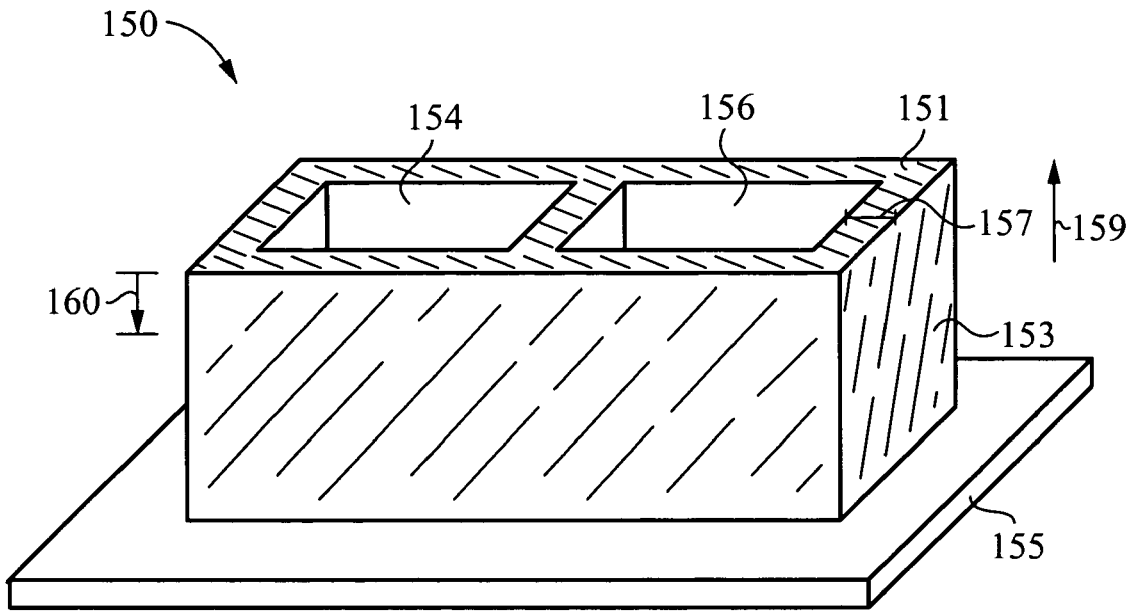
FIG. 1*c* illustrates a perspective view of a squeegee matrix.

FIG. 1*c* shows a two-cavity matrix structure 150. The matrix structure 150 protrudes from support surfaces 155 in a protruding direction 159 and preferably extends to distances in a range of 0.2 to 6.0 mm. The matrix structure 150 has edge surfaces 151, wall surfaces 153, and cavities 154 and 156. Matrix structures in accordance with the instant invention have any number of geometries and shapes. The matrix structure has a symmetrical or an asymmetrical network of wall surfaces, edge surfaces and cavities. Preferably, the averaged thickness 157 of the walls 153 are not greater than 2.0 mm and is most preferably less than 1.0 mm measured from distances 160 between the edge surfaces 151 of the structure 150 and 0.2 mm down from the edge surfaces 151 of the structure 150.

According to the current invention a contact device is configured to have at least one a resilient contact element. The contact element has a primary structure that is a nodule, a squeegee, an array or a matrix. The primary structure provides for first contact surfaces that are capable of contacting a working surface. The resilient contact element has at least one secondary structure that is coupled to the primary structure. The secondary structure is capable of exhibiting cooperative displacement with the primary contact structure. Cooperative displacement, herein, refers to the displacement of one structure through the displacement of another structure. Preferably, the secondary structure protrudes from surfaces or a surface region of the primary structure. Most preferably, the secondary structure protrudes from wall surfaces, edge surfaces or tip surfaces of the primary structure. The secondary structure is a nodule, a squeegee, an array, a matrix or a bristle structure. The secondary structure provides second contact surfaces that are capable of contacting the working surface.

Both the primary and the secondary structures are preferably resilient and formed from resilient materials including, but not limited, to plastics, rubbers, silicones, urethanes, latex and other elastomeric materials. The primary structure preferably has durometer hardness in a range of 10 to 90 Shores A. The secondary contact structure preferably comprises a bristle structure. The primary structure is preferably formed by injection molding or any other suitable molding technique known in the art. The secondary structures are preferably formed by fiber drawing techniques for forming bristles from plastic resin materials. Alternatively, the secondary structure is a nodule, a squeegee, any array or matrix also formed by molding techniques. The contact element can be modified by incorporating non-resilient materials such as abrasive particles into the primary and/or secondary structures.

Figure 2A:
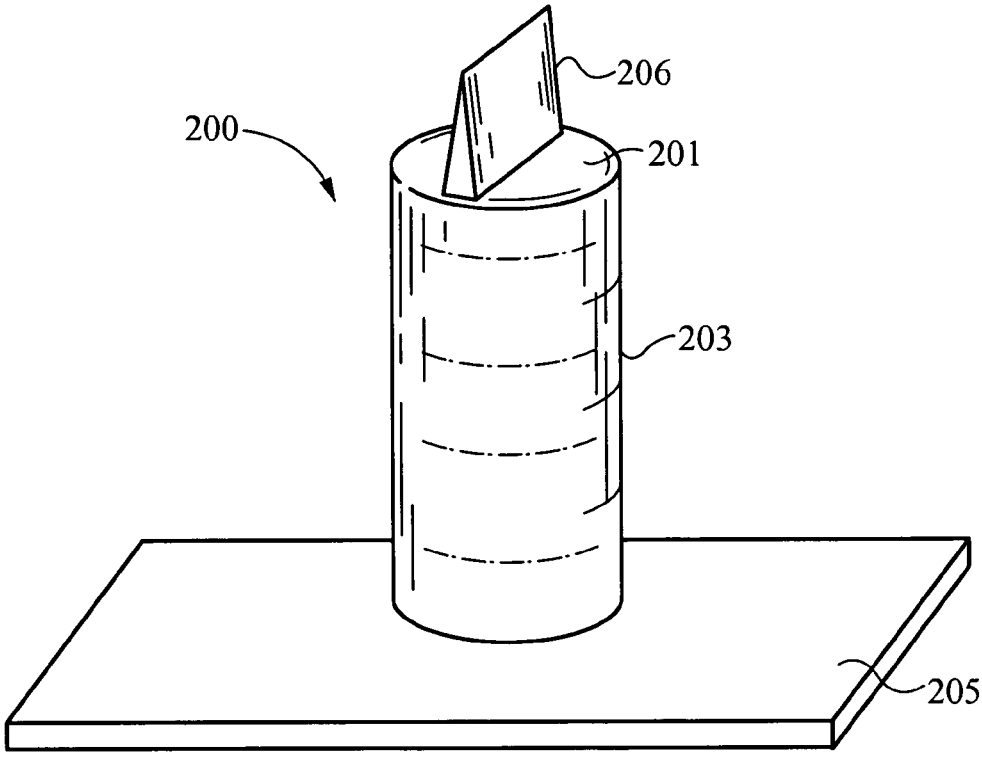
FIG. 2*a* shows a contact element with nodule structure and a squeegee structure protruding from top surfaces of the nodule structure.

FIG. 2*a* illustrates a contact element 200 with a nodule 203 protruding from support surfaces 205. The nodule 203 has contact surfaces 201 that are capable of engaging a working surface (not shown). The contact element 200 has a squeegee structure 206 coupled to the nodule 203 and protruding from the contact surfaces 201 of the nodule 203. The squeegee structure 206 provides the contact element 200 with a second set of contact surfaces that are capable of engaging the working surface. In accordance with the instant invention, the contact element 200 will engage the working surface with the squeegee 206 when a first force is applied to the working surface through the nodule 203. When a second and sufficiently greater force is applied to the working surface through the nodule 203, surfaces of the nodule 203 will also engage the working surface.

Figure 2B:
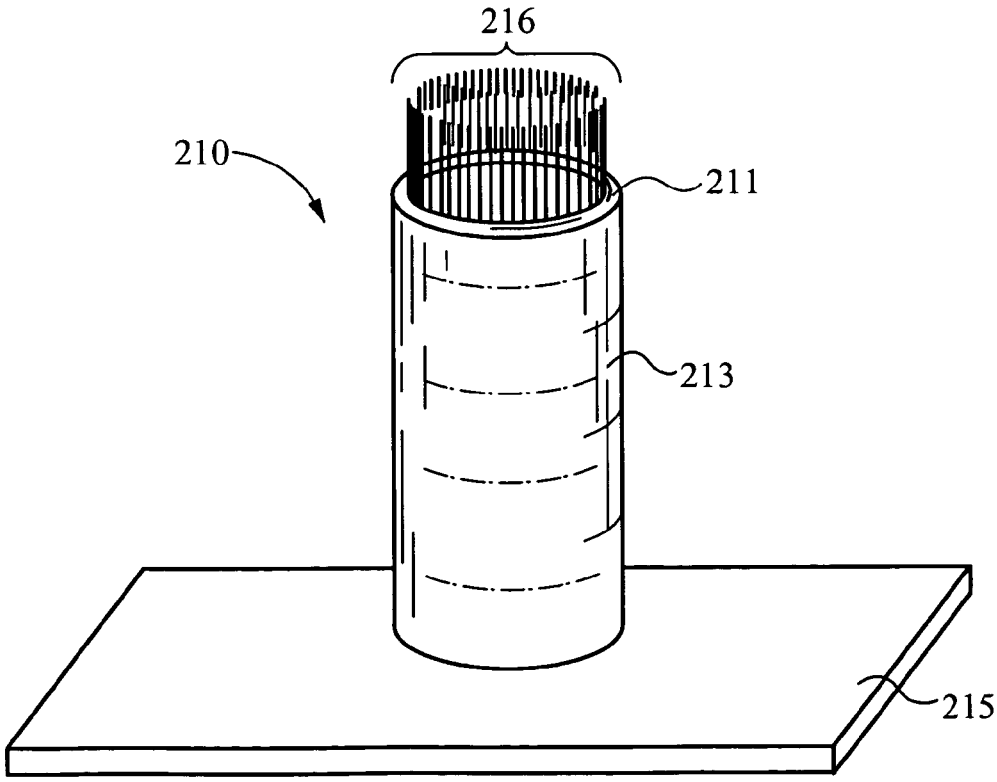
FIG. 2*b* illustrates a contact element with tubular squeegee structure and bristles protruding from edge surfaces of the squeegee structure.

FIG. 2*b* illustrates a contact element 250 with a tubular squeegee 253 protruding from support surfaces 255. The squeegee 253 has contact surfaces 251 that are capable of engaging a working surface (not shown). The contact element 250 has a bristle structure 256 coupled to the squeegee 253 and protruding from the surfaces 251 of the squeegee 253. The bristle structure 256 provides the contact element 250 with bristle surfaces that are capable of engaging the working surface. In accordance with the instant invention, the contact element 250 will engage a working surface with the bristles 256 when a first applied force is applied to the working surface through the squeegee 253. When a second, and sufficiently greater, force is applied to the working surface through the squeegee 253, surfaces 251 of the squeegee 253 will also engage the working surface.

Figure 2C:
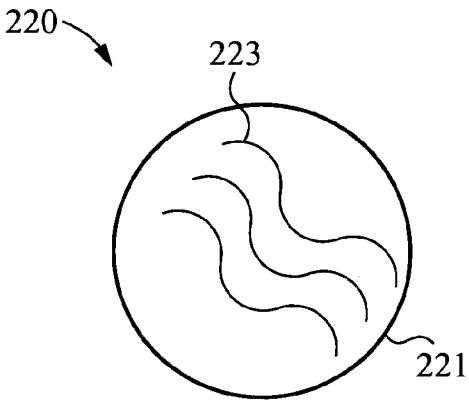
FIGS. 2*c-g* show top views of contact elements with nodule structures or squeegee structures protruding from top surfaces of the nodule structures, in accordance with the embodiments of the present invention.
Figure 2D:
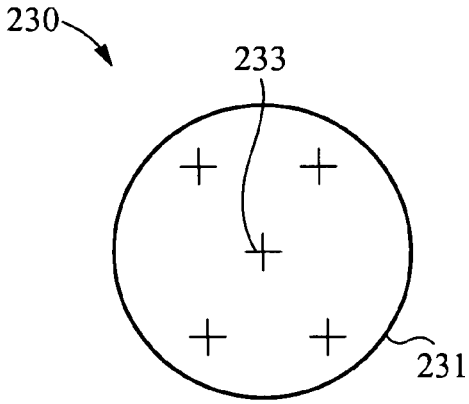
Figure 2E:
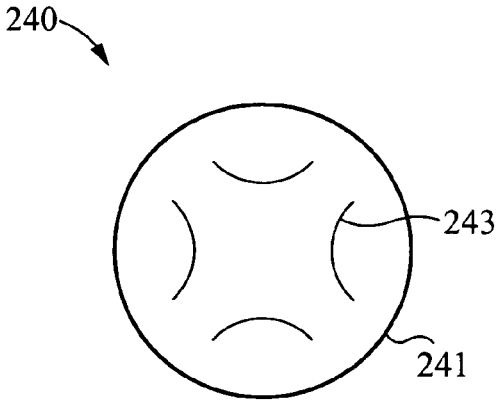
Figure 2F:
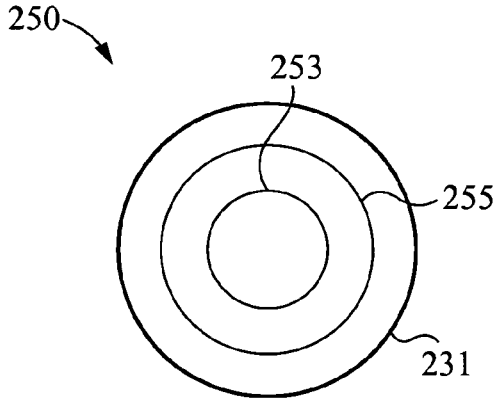
Figure 2G:
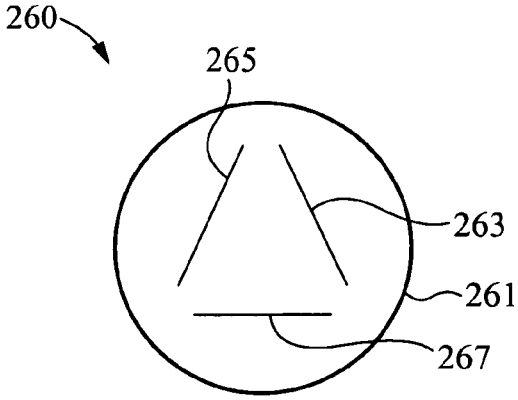

FIGS. 2*c-g* show top views of contact elements with primary nodule structures and secondary squeegee structures protruding from top surfaces of the primary nodule structures, in accordance with the embodiments of the present invention. FIG. 2*c* shows a contact element 220 comprising a plurality of wave-like or serpentine squeegee structures 223 protruding from a top surface of a nodule structure 221. FIG. 2*d* shows a contact element 230 comprising a plurality of cross-shaped squeegee structures 233 protruding from a top surface of a nodule structure 231. FIG. 2*e* shows a contact element 240 comprising a plurality of curved squeegee segments 243 protruding from a top surface of a nodule structure 241. FIG. 2*f* shows a contact element 250 comprising a plurality of continuous and concentrically positioned squeegee structures 253 and 255 protruding from a top surface of a nodule structure 231. FIG. 2*g* shows a contact element 260 comprising a plurality of linear squeegee segments 263, 265 and 267 protruding from a top surface of a nodule structure 261 and positioned at a range of angles with respect to each other. The contact elements illustrated in FIGS. 2*a-g* are provided as examples and it will be clear to one skilled in the art that contact elements can include a primary nodule structure with secondary squeegee structures protruding from a top surface that have any number of geometries or combinations of geometries.

Figure 3A:
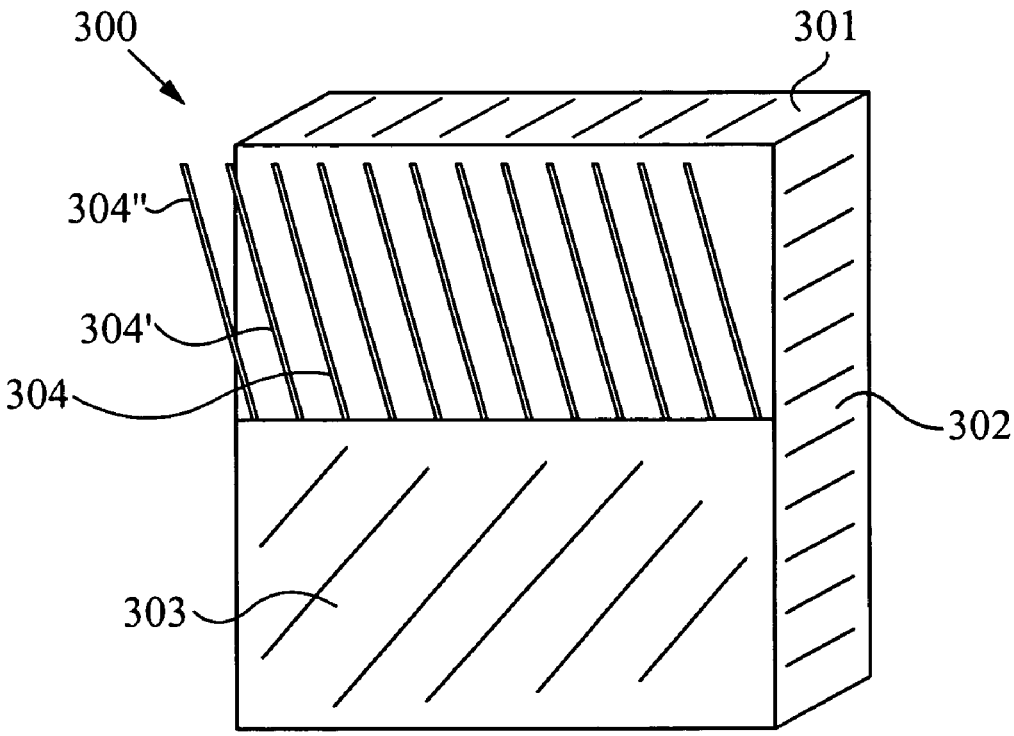
FIG. 3*a* shows a contact element with a squeegee structure and bristles protruding from wall surfaces of the squeegee structure.

FIG. 3*a* illustrates a contact element 300 with a squeegee structure 302. The squeegee structure 302 has edge surfaces 301 for engaging a working surface (not shown). Protruding from wall surfaces 303 of the squeegee 302, there are several bristles or bristle sections 304, 304' and 304". Preferably, the bristle sections 304, 304' and 304" and the squeegee surfaces 301 are cable of engaging the working surface simultaneously or individually depending on presentation angle of the contact element 300 relative to the working surface and the force that is applied to the working surface through the contact element. The contact element 300 provides the contact properties of a squeegee and bristles in a single multi-structural contact element. The bristles 304, 304' and 304" can at any angle 306 relative to the protruding wall surfaces 303 suitable for the application at hand.

Figure 3B:
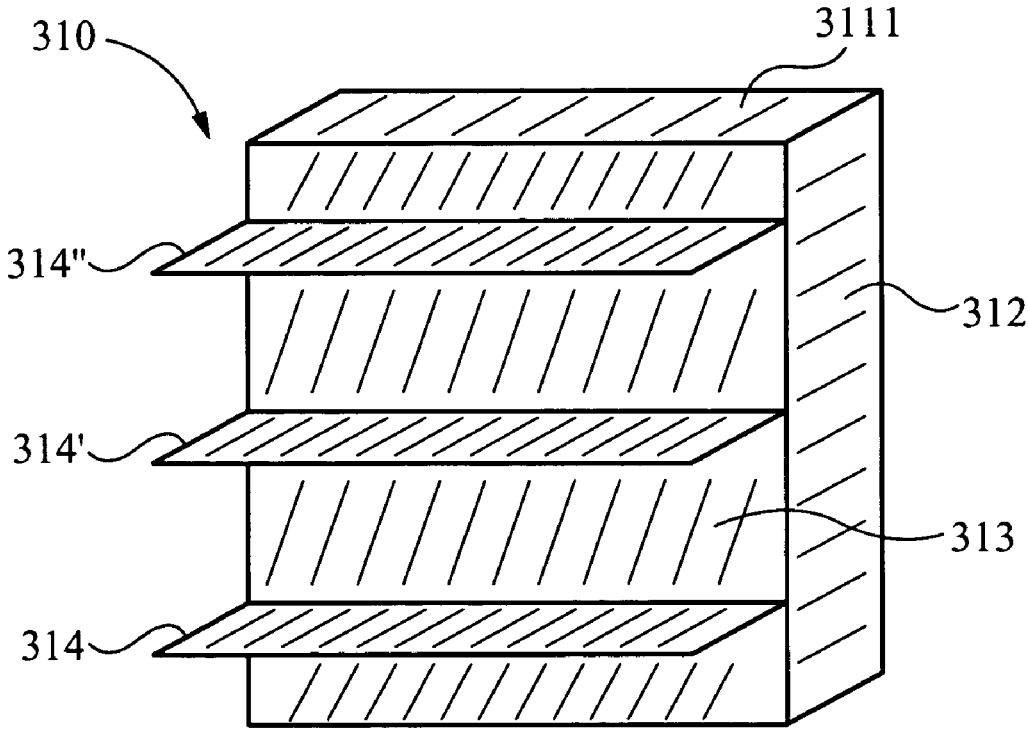
FIG. 3*b* shows a contact element with a primary squeegee structure and secondary squeegee structure protruding from wall surfaces of the primary squeegee structure.

FIG. 3*b* illustrates a contact element 350 with a squeegee structure 352. The squeegee structure 352 has edge surfaces 351 for engaging a working surface (not shown). Protruding from wall surfaces 353 of the squeegee 352 there are several secondary squeegees 354, 354' and 354". Preferably, the secondary squeegee structures 354, 354' and 354" and the squeegee surfaces 351 are cable of engaging the working surface. The secondary squeegees 304, 304' and 304" and the squeegee surfaces 351 engage the working surface simultaneously or individually depending on presentation angle of the contact element 350 relative to the working surface and the force that is applied to the working surface through the contact element as explained in detail above.

Figure 3C:
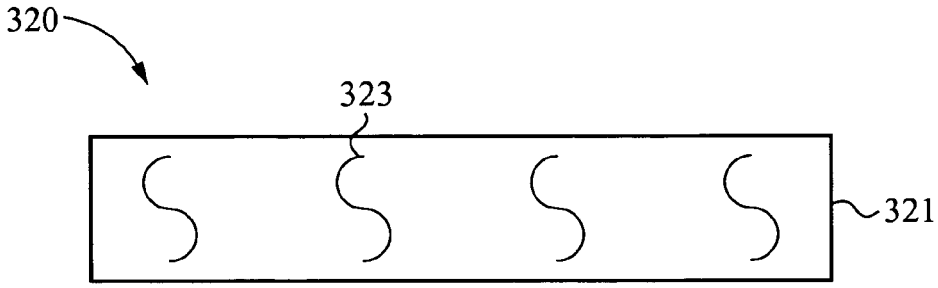
FIGS. 3*c-f* show schematic representations of contact elements with a primary squeegee structures and secondary squeegee structures protruding from wall surfaces of the primary squeegee structure, in accordance with the embodiments of the invention.
Figure 3D:
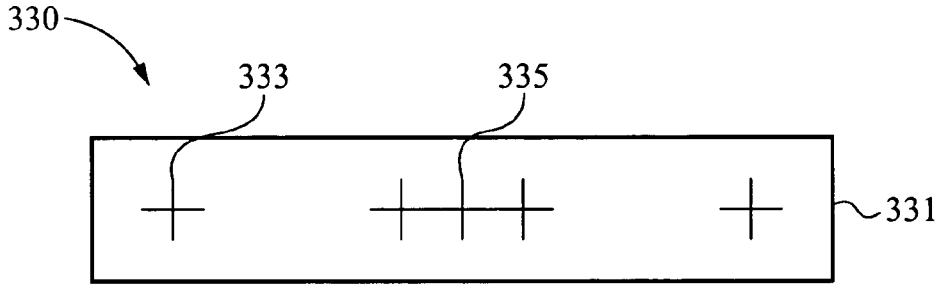
Figure 3E:
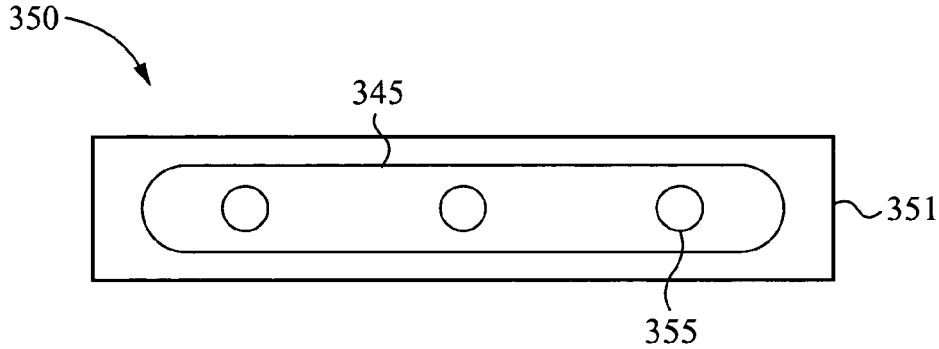
Figure 3F:
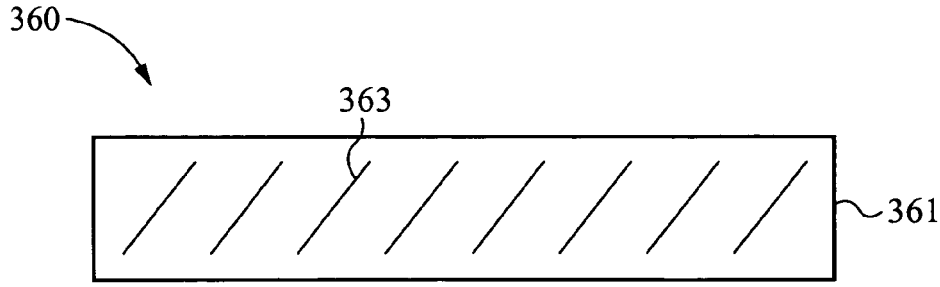

FIGS. 3*c-f* show schematic representation of contact elements with a primary squeegee structures and secondary squeegee structures protruding from wall surfaces of the primary squeegee structures, in accordance with the embodiments of the invention. FIG. 3*c* shows a contact element 320 with a squeegee structure 321 and a plurality of wave-like of serpentine squeegee structures 323 protruding from a wall of squeegee structure 321. FIG. 3*d* shows a contact element 330 with a squeegee structure 331 and a plurality of cross-shaped squeegee structures 333 and 335 protruding from a wall of squeegee structure 331. The squeegee structure 335 includes a longer squeegee segment with a plurality of smaller squeegee segments that intersect with the longer squeegee segment forming a backbone-shaped squeegee 335. FIG. 3*e* shows a contact element 350 with a squeegee structure 351 and a plurality of continuous squeegee structures 335 and 345 protruding from a wall of squeegee structure 331. The continuous squeegee structures 345 surrounds the smaller squeegee structures 355. FIG. 3*f* shows a contact element 360 with a squeegee structure 361 and a plurality of linear squeegee segments 363 protruding from a wall of squeegee structure 361.

Figure 4A:
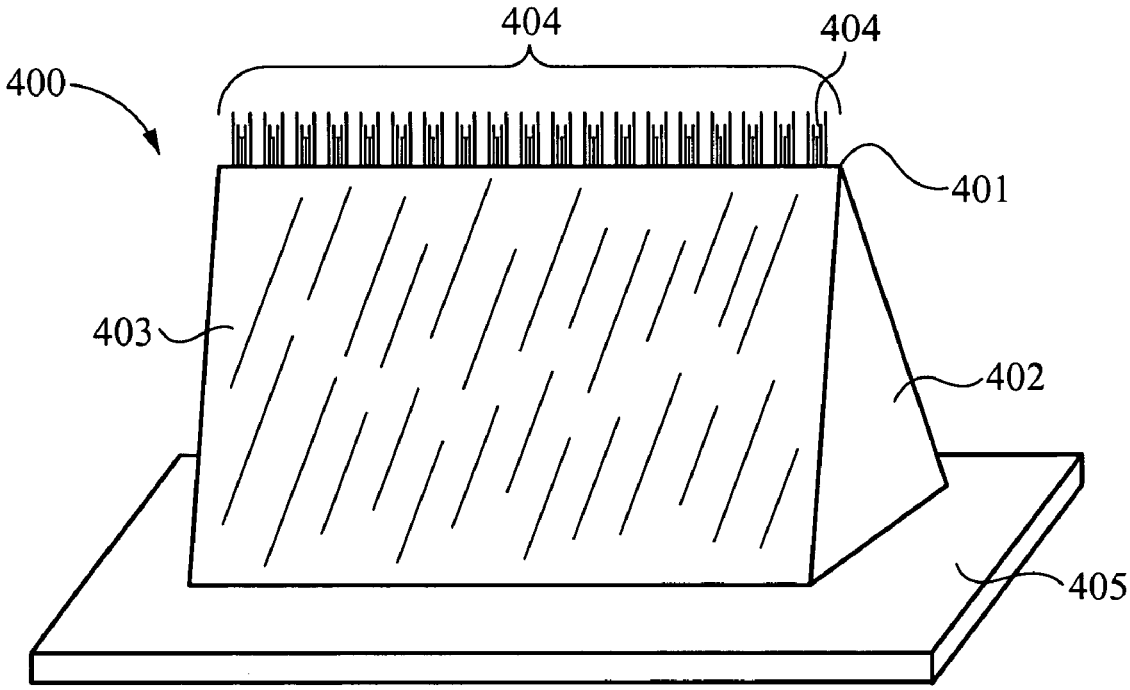
FIG. 4*a* shows a contact element with a tapered squeegee structure and bristles protruding from edge surfaces of the squeegee structure.

FIG. 4*a* illustrates a contact element 400 with a tapered squeegee 402 protruding from support surfaces 405. The squeegee 402 has wall surfaces 403 and edge surfaces 401 that are capable of engaging a working surface (not shown). The contact element 400 has a bristle structure 404 couple to the squeegee 402 and protruding from the edge surfaces 401 of the squeegee 402. The bristle structure 404 provides the contact element 400 with bristle surfaces that are also capable of engaging the working surface. The contact element 400 will engage the working surface with the bristles 404 when a first force is applied to the working surface through the squeegee 402. When a second, and sufficiently greater, force is applied to the working surface through the squeegee 401, the edge surfaces 401 and wall surfaces 403 of the squeegee 402 will also engage the working surface.

Figure 4B:
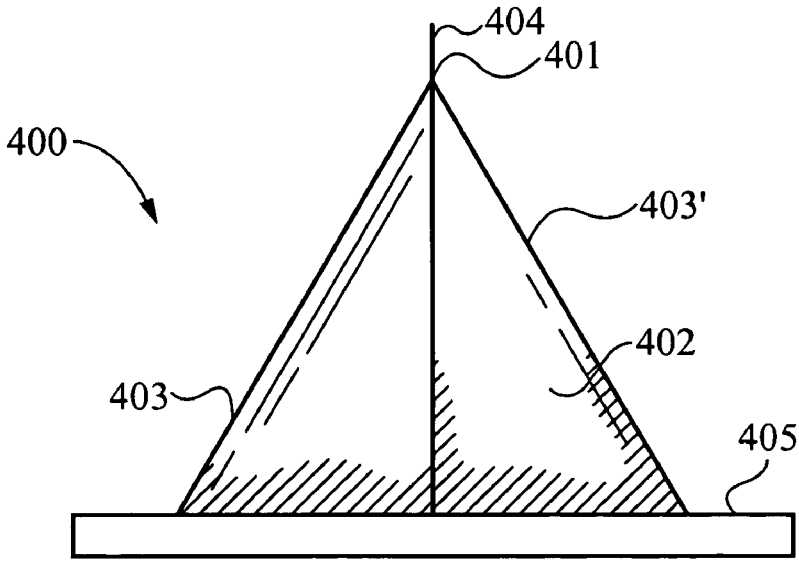
FIG. 4*b* is a cross-sectional view of the contact element shown in FIG. 4*a,* illustrating bristles extending through the squeegee structure.

FIG. 4*b* shows a cross-sectional view of the contact element 400 illustrated in the FIG. 4*b*. The tapered squeegee 402 has wall surfaces 403 and 403' and the edge surfaces 401 that are capable of engaging a working surface, as described above. The bristles 404 are preferably attached to the support 405 extend through a portion of the squeegee 402 and protrude from wall surfaces 403 and 403' or edge surfaces 401, as shown. The bristles of the bristle structure 404 are not required to extend through the entire squeegee 402 to practice the invention and may be couple to surfaces of the squeegee structure 402 by other means known in the art.

Figure 5A:
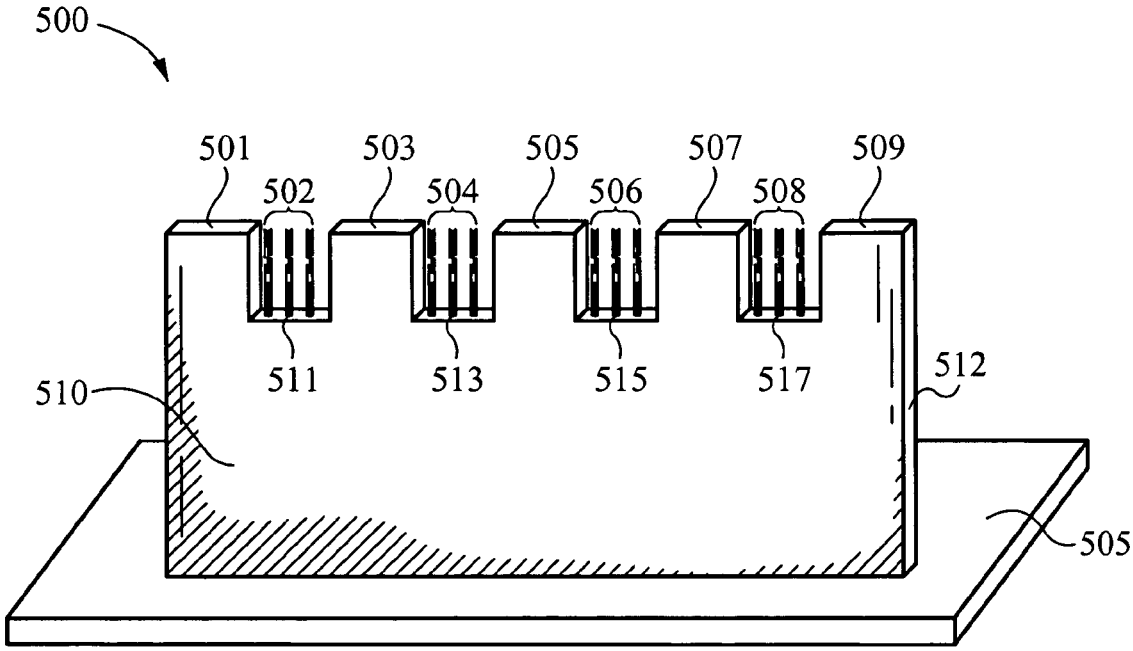
FIG. 5*a* shows a contact element with a contoured squeegee structure and with bristles protruding from between depressed regions of the contoured squeegee structure.

FIG. 5*a* illustrates a contact element 500 that has a squeegee structure 512 which protrudes from support surfaces 505 with protruding squeegee walls 510. The squeegee element 512 is contoured with teeth 501, 503, 505, 507, and 509. Between the teeth 501, 503, 505, 507, and 509 there are notches or depressions 511, 513, 515 and 517. On the surfaces of the notches 511, 513, 515 and 517 there are bristle sections 502, 504, 506 and 508, respectively. The squeegee teeth 501, 503, 505, 507, and 509 and the bristle sections 502, 504, 506 and 508 are made to be longer or shorter relative to each other depending on the application at hand. When squeegee teeth 501, 503, 505, 507, and 509 are longer than the bristle sections 502, 504, 506 and 508, as shown, then the squeegee teeth 501, 503, 505, 507, and 509 (or a portion thereof) will engage a working surface (not shown) when a first force is applied to the working surface through squeegee structure 512. When a second, and sufficiently greater, force is applied to the working surface through the squeegee structure 512, then the bristle sections 502, 504, 506 and 508 (or a portion thereof) will also contact the working surface. Alternatively, the squeegee teeth 501, 503, 505, 507, and 509 and the bristle sections 502, 504, 506 and 508 are made to have the same length such that the teeth 501, 503, 505, 507, and 509 and bristle sections 502, 504, 506 and 508 engage a working surface simultaneously. The contact device of the instant invention is configured with any number of teeth and bristles sections suitable for the application at hand.

Figure 5B:
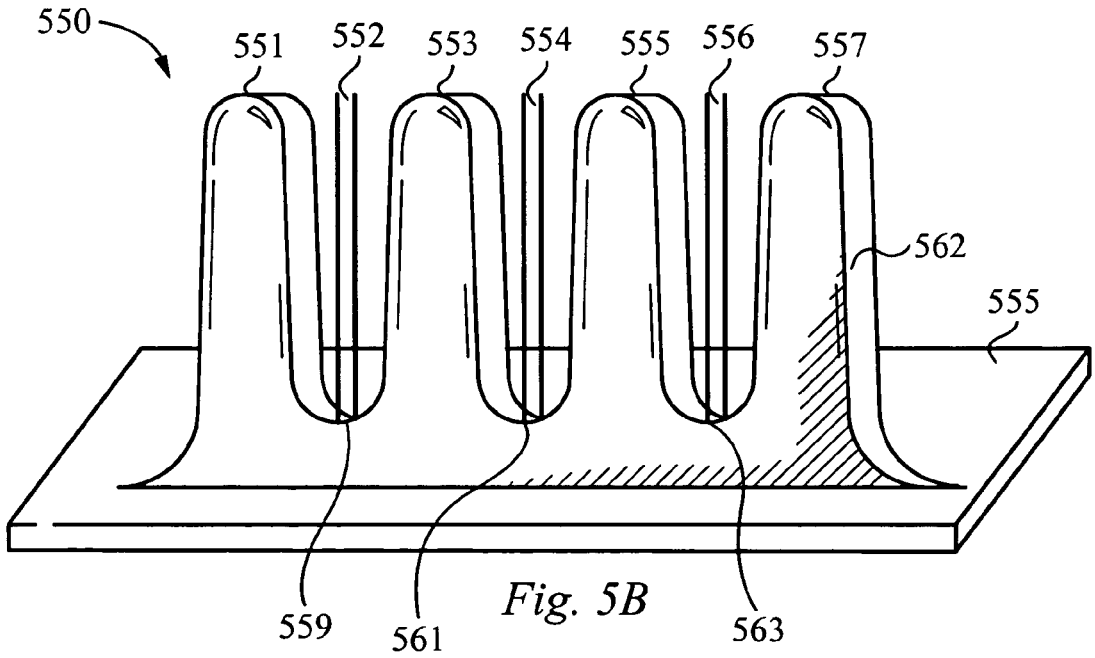
FIG. 5*b* shows a contact element with nodular protrusions and with bristles protruding from surfaces between the nodular protrusions of the contact element.

FIG. 5*b* illustrates a contact element 550 that has an extended nodular structure 562 that protrudes from support surfaces 555 with protruding nodules 551, 553, 555 and 557.

Between the protruding nodules 551, 553, 555 and 557, there are depressed surfaces 559, 561, and 563. Protruding from the depressed surfaces 559, 561 and 563 there are bristle sections 552, 554, and 556. The nodules 551, 553, 555 and 557 and the bristle sections 552, 554, and 556 are made to be longer or shorter or the same, as explained above relative to each other depending on the application at hand. Alternatively, the nodules 551, 553, 555 and 557 and the bristle sections 552, 554, and 556 are made to have the same length so that the nodules 551, 553, 555 and 557 and bristle sections 552, 554, and 556 contact a working surface simultaneously. Further, the contact device of the instant invention is configured with any number of teeth and bristles sections suitable for the application at hand.

Figure 6A:
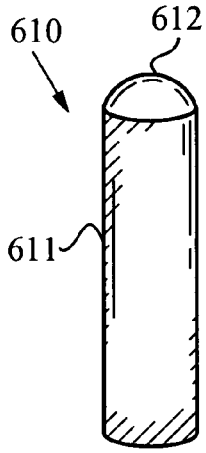
FIGS. 6*a-h* illustrate several exemplary symmetrical nodular structures.
Figure 6B:
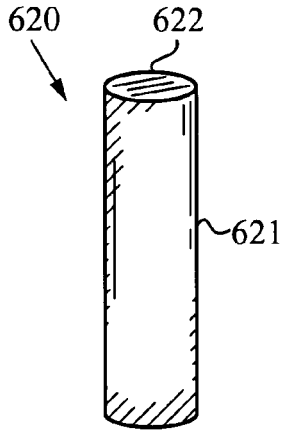
Figure 6C:
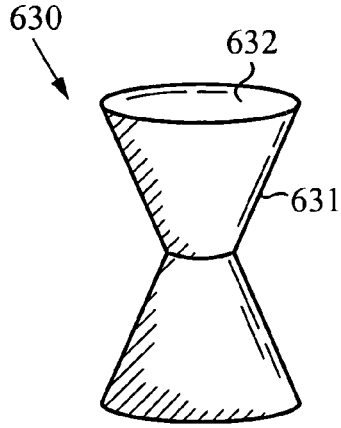
Figure 6D:
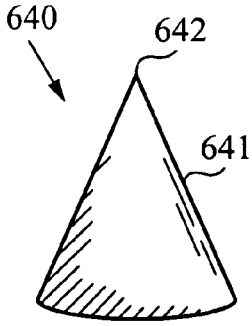
Figure 6E:
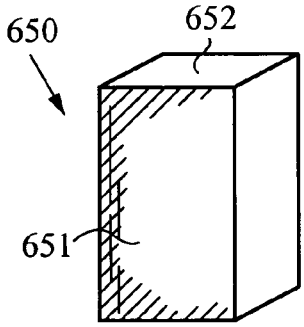
Figure 6F:
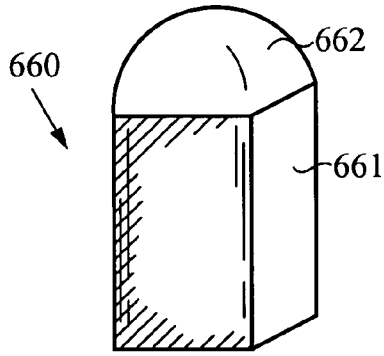
Figure 6G:
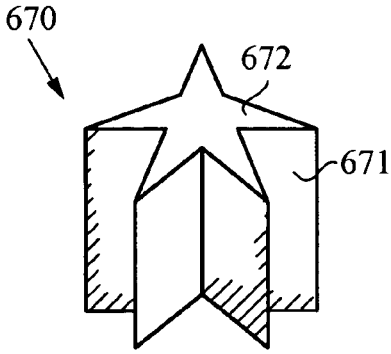
Figure 6H:
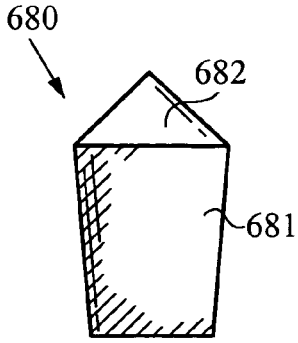

FIGS. 6*a-h* illustrate several symmetrical nodule structure geometries that are useful in the contact device of the instant invention. FIG. 6*a* shows a nodule 610 with cylindrical protruding walls 611 and a rounded tip portion 612; FIG. 6*b* shows a nodule 620 with cylindrical protruding walls 621 and a flat top 622; FIG. 6*c* shows a nodule 630 with contoured protruding walls 631 and a flat top 632; FIG. 6*d* shows a pointed nodule 640 with tapered protruding walls 641 and a tip 642; FIG. 6*e* shows a rectangular nodule 650 with planar walls 651 and a flat top 652; FIG. 6*f* shows a nodule 660 with planar walls 661 and a rounded tip portion 662; FIG. 6*g* shows a star shaped nodule 670 with protruding walls 671 and a star-shaped top 672; FIG. 6*h* shows a triangular nodule 680 with protruding walls 681 and triangular-shaped top 682.

Figure 7A:
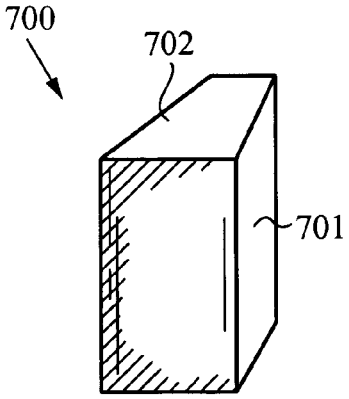
FIGS. 7*a-*7*g* illustrate several exemplary asymmetric nodular structures.
Figure 7B:
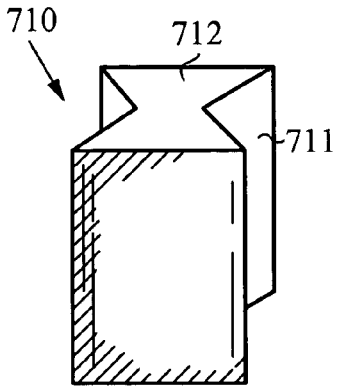
Figure 7C:
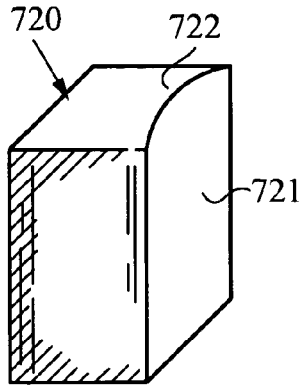
Figure 7D:
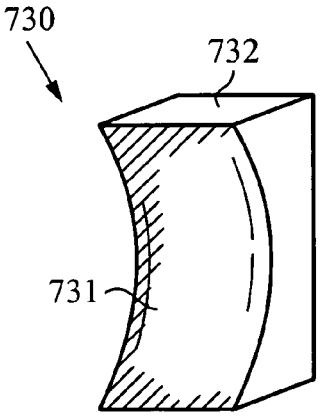
Figure 7E:
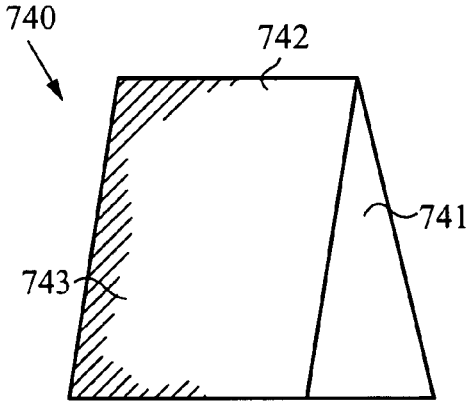
Figure 7F:
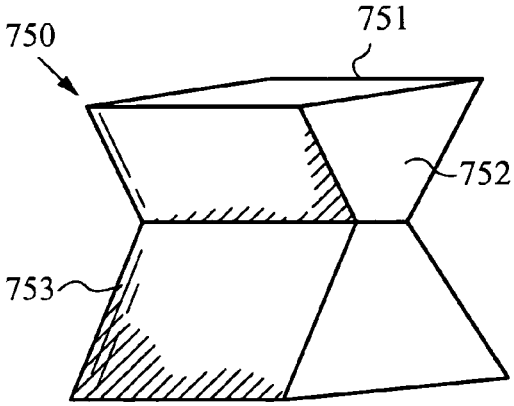
Figure 7G:
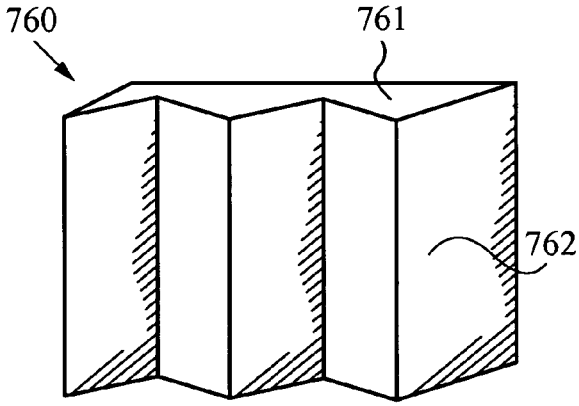

FIGS. 7*a-g* illustrate several asymmetrical nodule structure geometries that are useful in the contact device of the instant invention. FIG. 7*a* shows a wedge-shaped nodule 700 with protruding walls 701 and a top 702; FIG. 7*b* shows a nodule 710 with contoured walls 711 and a bow-tie shaped top 712; FIG. 7*c* shows a curved nodule 720 with protruding walls 721 (curved in the elongation direction) and a flat top 722; FIG. 7*d* shows a curved nodule 730 with protruding walls 733 (curved in the protruding direction) and a top 732; FIG. 7*e* shows a wedge shaped nodule 740 with tapered walls 743, triangular walls 741 and an edge 742; FIG. 7*f* shows a nodule 750 with grooved walls 753, bow-tie shaped walls 752 and a flat top 751; and FIG. 7*g* shows a nodule 760 with contoured walls 762 and a top 761. It will be clear to one of average skill in the art that any number of symmetric and asymmetric nodule geometries and combinations thereof are useful in the contact device of the instant invention.

Figure 8A:
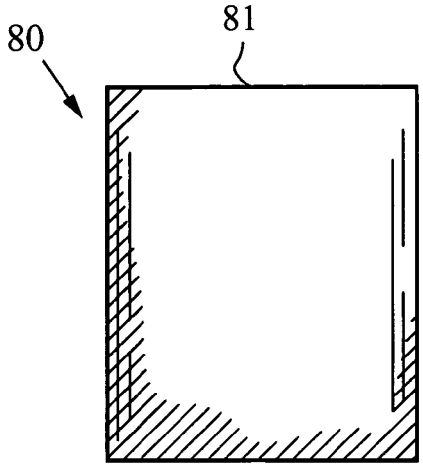
FIGS. 8*a-f* illustrate several exemplary contoured tip and edge surfaces.
Figure 8B:
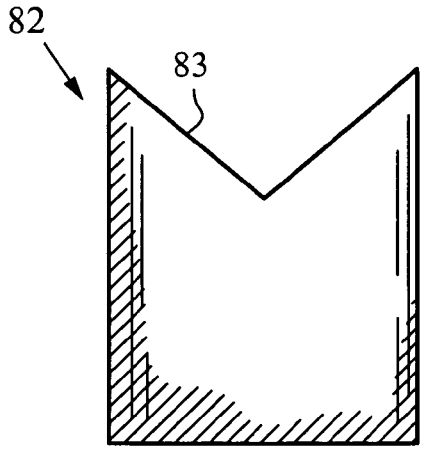
Figure 8C:
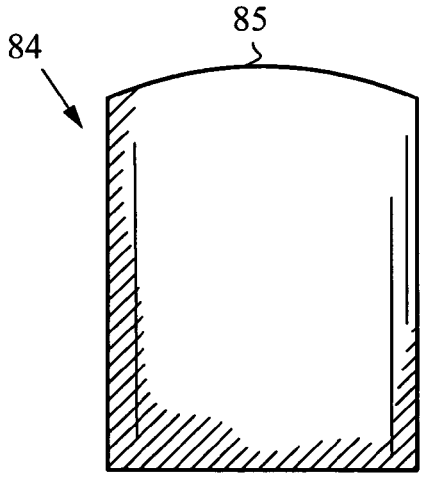
Figure 8D:
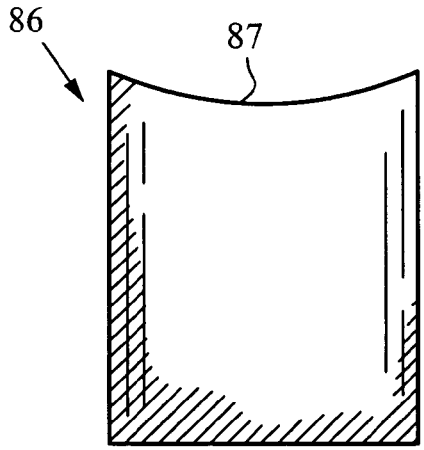
Figure 8E:
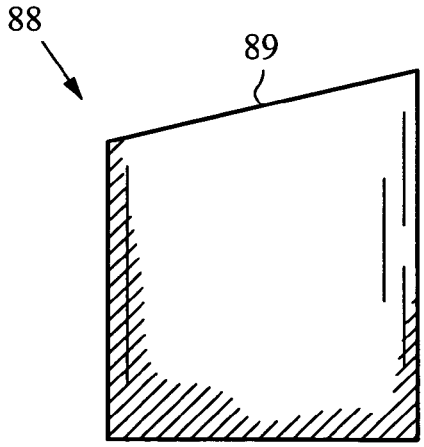
Figure 8F:
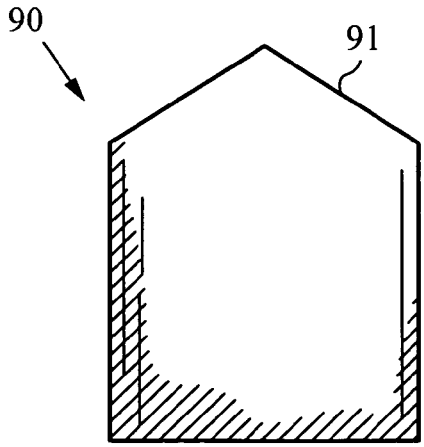

FIG. 8*a-f* illustrate several edge and tip contours of contact structures used in the instant invention. FIG. 8*a* shows a contact structure segment 80 with a planar contact edge 81; FIG. 8*b* shows a contact structure segment 82 with a V-shaped contact edge 83; FIG. 8*c* shows a contact structure segment 84 with a curve convex contoured contact edge 85; FIG. 8*d* shows a contact structure segment 86 with a concave contoured contact edge 87; FIG. 8*e* shows a contact structure segment 88 with a diagonally contoured contact edge 89; and FIG. 8*f* shows a contact structure segment 90 with a pointed contact edge 91.

Figure 9A:
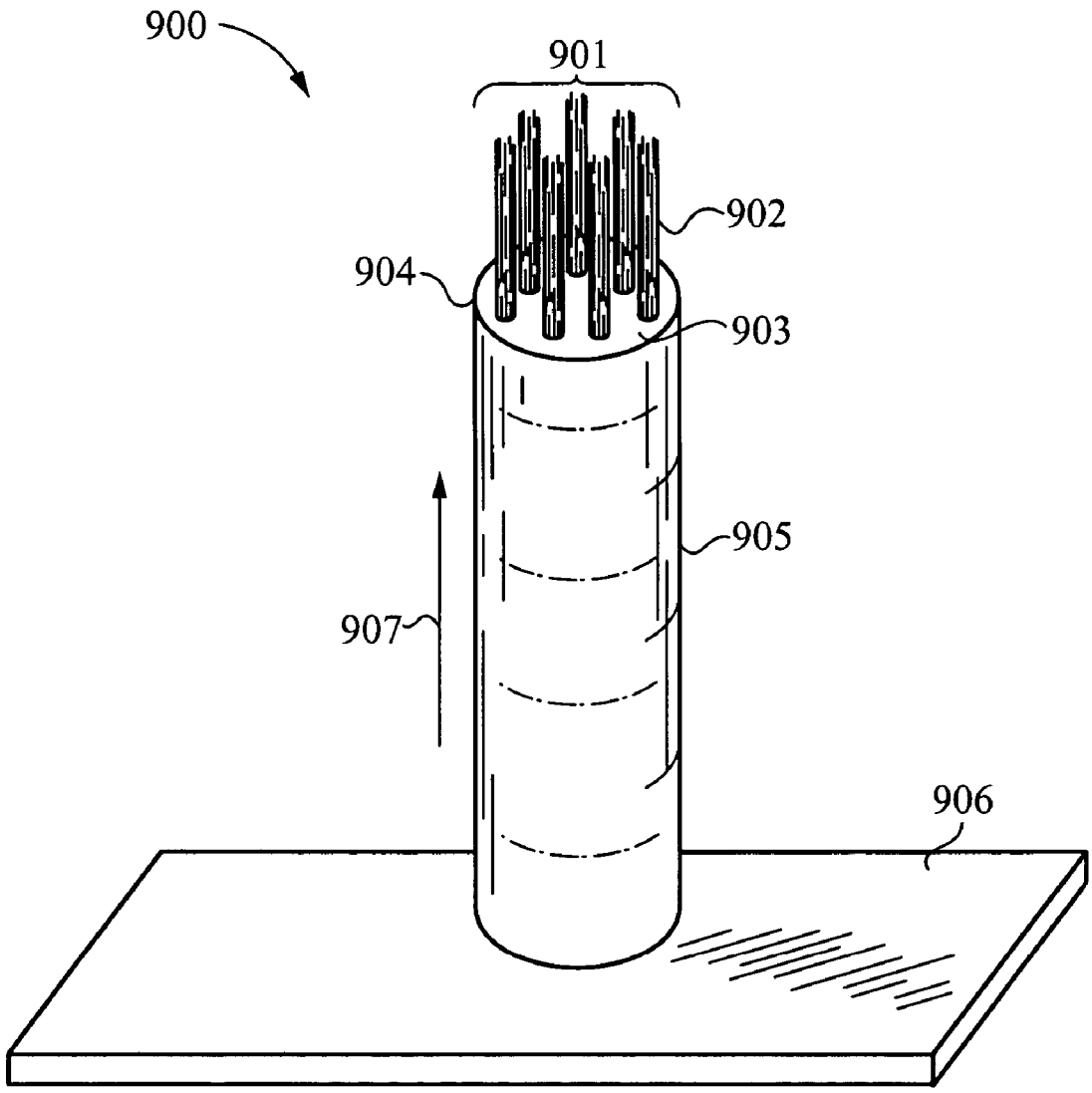
FIG. 9*a* shows a contact element with a nodular structure and a bristle structure protruding from tip surfaces of the nodular structure.

FIG. 9*a* shows a contact element 900 with a primary nodular structure 905 that protrudes from a support structure 906 in a protruding direction 907. The support structure 906 is rigid or flexible depending on the intended application. The support 906 and the nodule 905 are formed of the same or different material and are made in parts or are co-molded as a monolithic unit. According to an embodiment of the invention, a contact device has one or more contact elements or an array of contact elements such as the one shown in the FIG. 9*a*.

Still referring to the FIG. 9*a*, the contact element 900 has a bristle structure 901 comprising bristle groupings 902 protruding from top surfaces 903 of the nodule 905. Alternatively, a bristle structure protrudes from wall surfaces or edge surfaces 904 of the nodule 905 or any combination of surfaces and edges. The bristle structure 901 is comprised of bristles that are formed from resilient materials, including but not limited to, natural hair, plastics, rubbers, silicones, urethanes latex and elastomeric materials. Bristles, while typically hard, are made to be flexible and resilient by virtue of their thin elongated geometries.

Figure 9B:
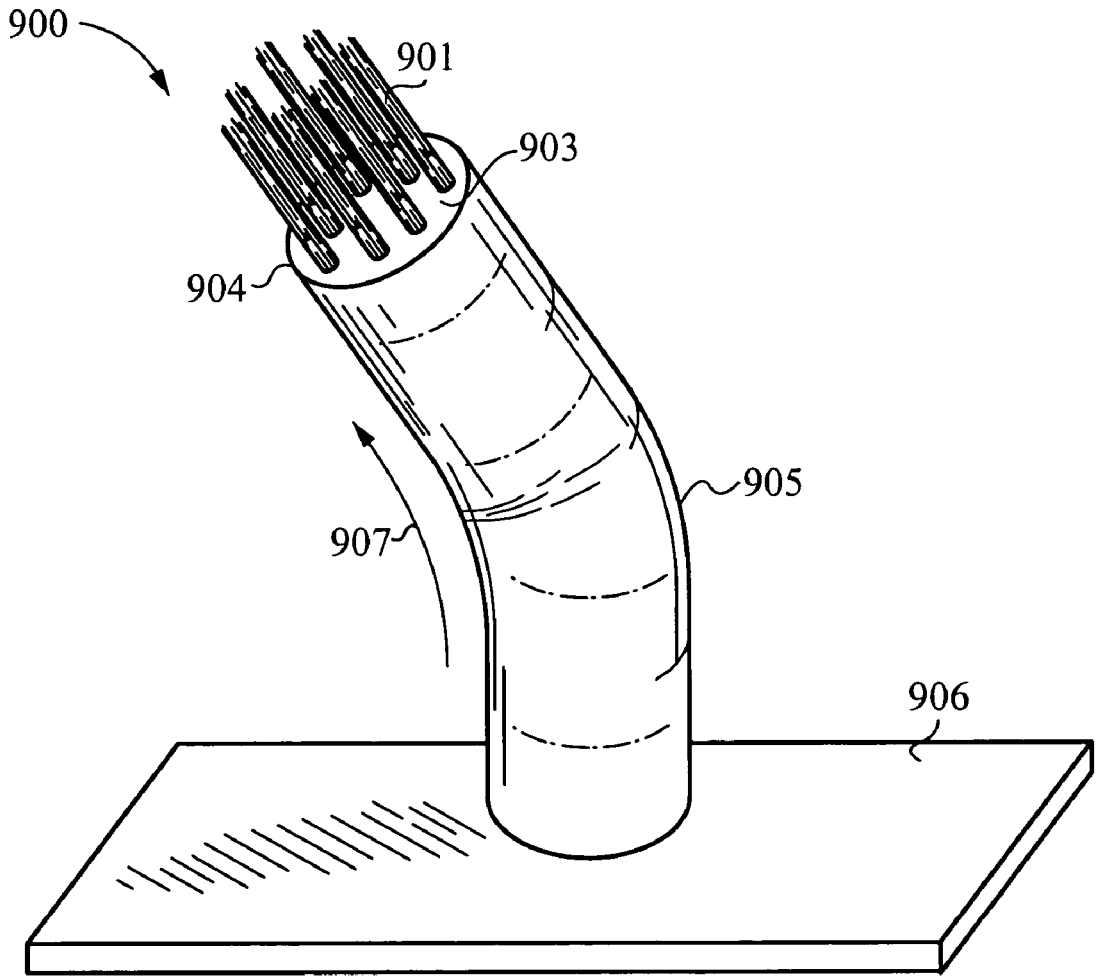
FIG. 9*b* illustrates the contact element shown in the FIG. 9*a* bending at the body portion of the nodule structure and concurrently displacing the bristle structure attached thereto.

Now referring to FIG. 9*b*, when the nodule structure 905 of the contact element 900 is displaced in the direction 907, then the bristle structure 901 exhibits cooperative displacement with the nodule structure 905. Accordingly, the contact behavior of the element 900 depends on the relative flexibility or rigidity of the primary 905 and secondary 901 contact structures. For example, when the bristle structure 901 is made to be sufficiently rigid relative to the nodule structure 905, then engaging the bristle structure 901 with a working surface (not shown) and applying a force to the working surface through the nodule 905 will cause the nodule 905 to deflect as shown in the FIG. 9*b*. Making the nodule structure 905 more flexible that the bristle structure 901 allows the nodule structure 905 to function as a cushion for the more rigid abrasive bristle structure 901. Alternatively, when the bristle structure 901 is made to be more flexible relative to the nodule structure 905, then engaging the bristle structure 901 with the working surface and applying a force to the working surface through the nodule 905 will cause the bristle structure 901 to be displaced from its equilibrium resting position. If the bristles are sufficiently flexible, then the bristles of the bristle structure 901 will be completely displaced and surfaces of the nodule 905 will also contact the working surface. When the nodule structure 905 and the bristles of the bristle structure 901 are made to exhibit similar flexibility, then engaging the bristle structure 901 with the working surface and applying a force to the working surface through the nodule 905 displaces both the nodule 905 and the bristle structure 901 from their respective equilibrium resting positions.

Figure 10A:
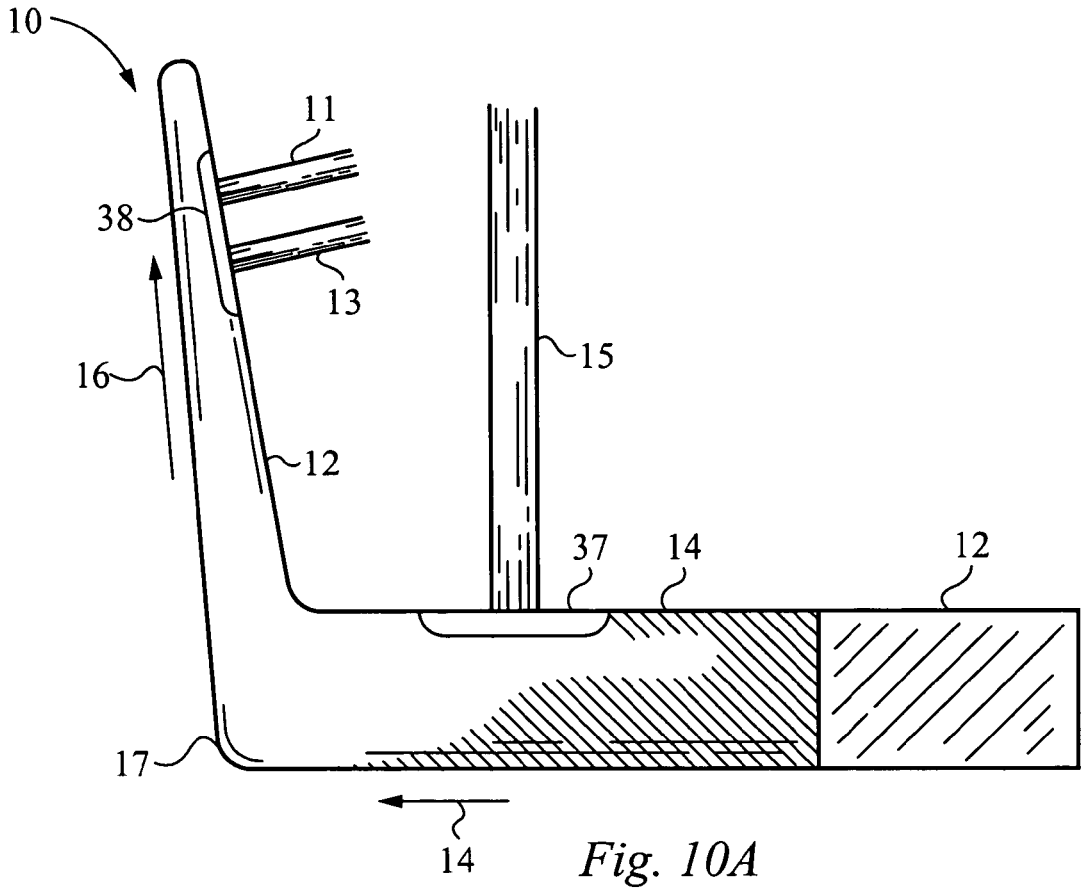
FIG. 10*a* shows a cross-sectional view of a contact element with a structure having an L-shaped cross-section and bristles protruding from inner walls of the L-shaped cross-section.

FIG. 10*a* shows a cross-sectional view of a contact element 10 in accordance with an alternative embodiment of the invention. The primary structure 17 is a bent nodule or squeegee structure. The primary structure 17 protrudes from a support structure 12 that is either rigid or flexible or a combination of rigid and flexible components. The primary structure 17 protrudes from the support 12 with a base portion 18 in a direction 14 and further extends with a wall portion 19 in a second direction 16. Protruding from the interior surfaces of the base portion 18 and the wall portion 12 of the structure 17 are bristle structures 11, 13 and 15. Depending on where the structure 17 is bent from or displaced, different groups of the bristle structures 11, 13 and 15 will exhibit cooperative displacement.

Figure 10B:
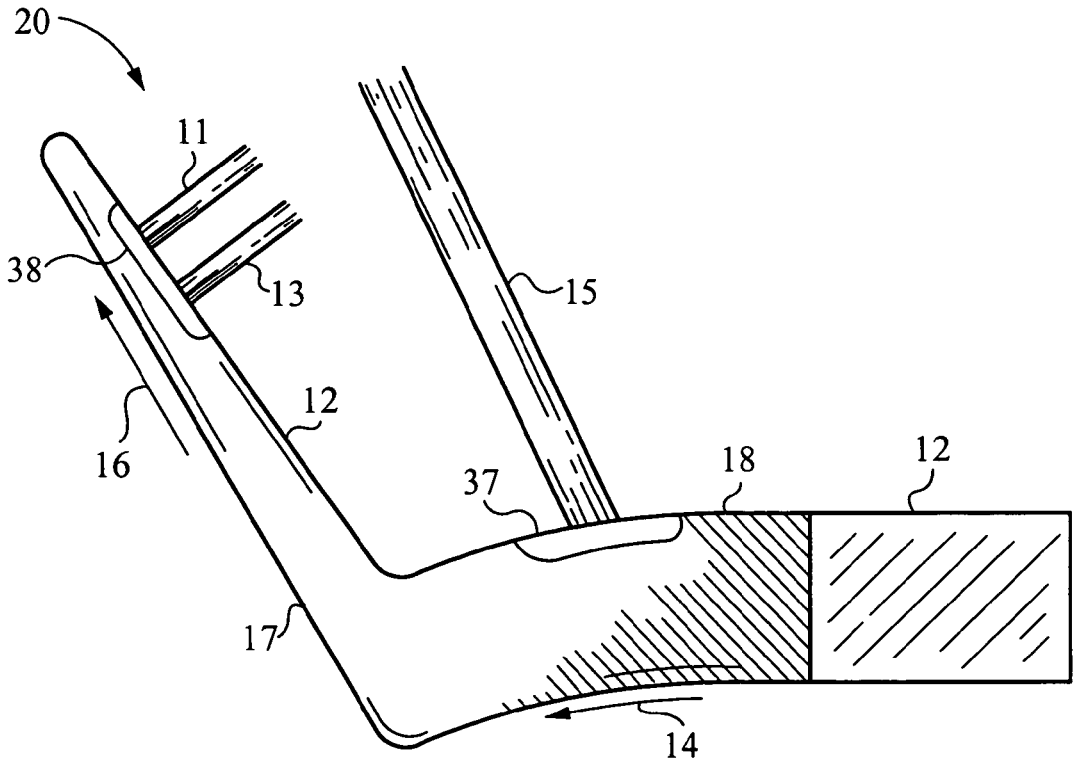
FIG. 10*b* shows cooperative displacement of bristle structures protruding from the L-shaped cross-section of the contact element illustrated in the FIG. 10*a.*
Figure 10C:
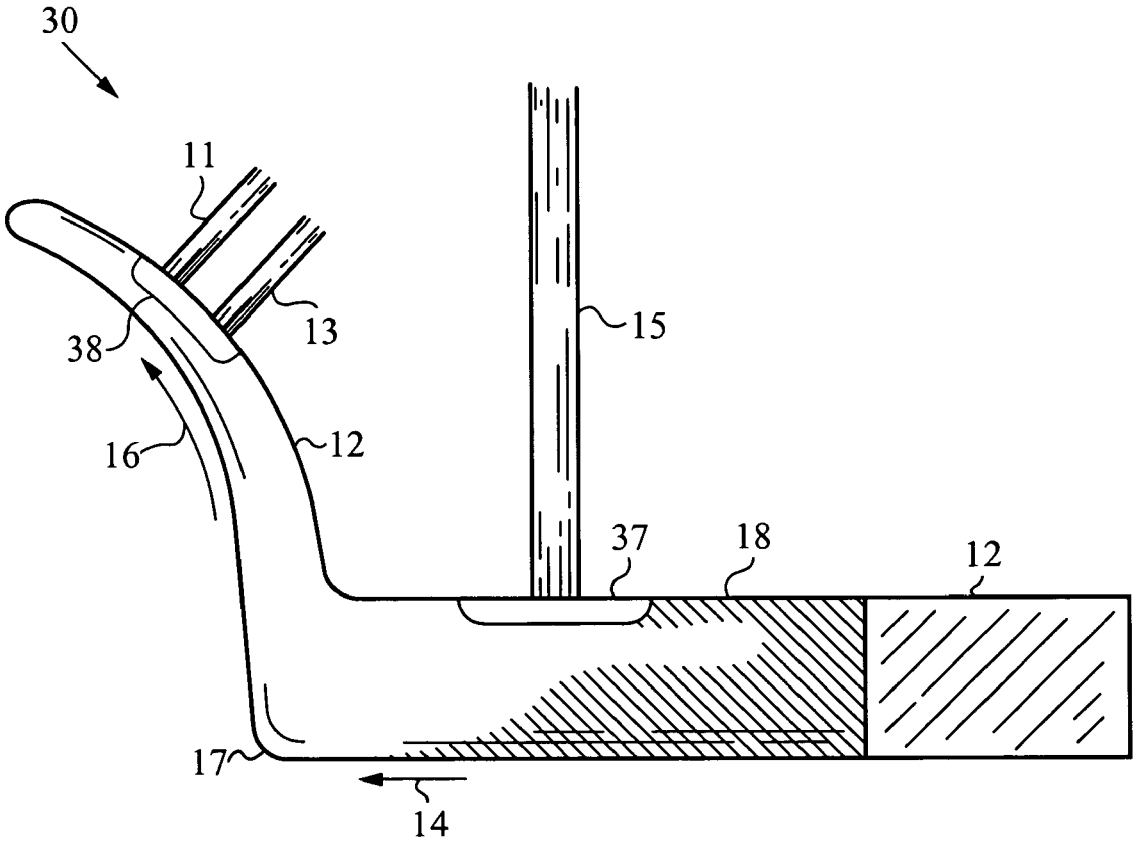
FIG. 10*c* shows cooperative displacement of a selective set of bristles protruding from the structure L-shaped cross-section of the contact element illustrated in the FIG. 10*a.*

Now referring to FIG. 10*b*, displacement of the structure 17 from its equilibrium resting position in the direction 14 will causes all of bristle structures 11 13 and 15 to be displaced as shown. Now referring to the FIG. 10*c*, displacement of the structure 17 from its equilibrium resting position in the direction 16 will cause the bristle structures 11 and 13 to be displace as shown and leave the bristle structure 15 in substantially the same position relative to the support structure 12. Bristle structures such as 11 13 and 15 can be configured to protrude for the structure 17 at any angle relative to the surfaces of the base portion 18 and the wall portion 12, but preferably protrude from the wall portion at an angle 9 between 90 and 10 degrees relative to the wall portion 12.

Figure 11A:
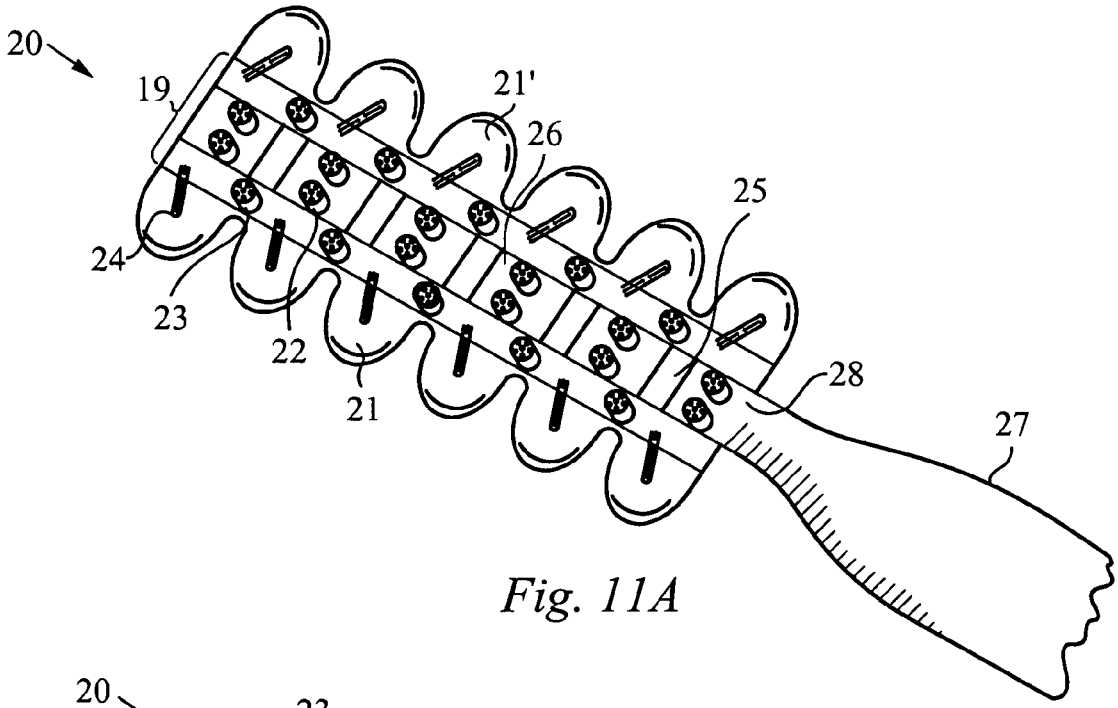
FIGS. 11*a-c* illustrate several views of a dentition cleaning device, in accordance with the embodiments of the invention.

FIG. 11*a* shows a top view of a contact device in accordance with the preferred embodiment of the invention. The device 20 is preferably configured for cleaning dentition. The device 20 has a handle portion 27 for griping and manipulating the device 20 during a cleaning operation. The device 20 has at least one primary structure 29 that preferably forms two sides 21 and 21' giving the device 20 a cleaning cavity or channel. Preferably, the primary structure 29 has a plurality of nodular protrusions 21 that contact surfaces of teeth and gums or dentures during a cleaning operation. The device 20 also preferably has a plurality of bristle structures 23 and 24 that protrude from inner surfaces of the primary structure 29. The primary structure 29 is attached to the handle portion 27 through a support structure 28. The support structure 28 is preferably a channel support structure that is formed of rigid or flexible materials. Alternatively, the channel 28 comprises interspersed flexible segments 25 and rigid segments 26, which allow the channel structure 28 to bend and deform as required during use. Protruding from the channel structure 28 are bristle sections 22 and 23 that have any number of bristles with any number bristle arrangements or configurations. The bristle sections 22 and 23 are comprised of needle-like bristles having any resiliency, texture, geometry or hardness required to facilitate the cleaning of teeth and dentures. The bristles are preferably formed by fiber drawing procedures known in the art. The bristles are formed from nylon, polyester, polyamide or any other suitable plastic resin.

Figure 11B:
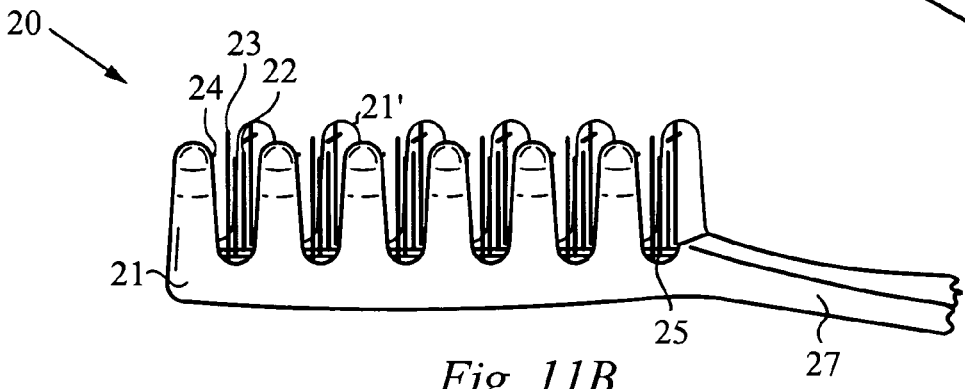

FIG. 11*b* shows a perspective side view of the dentition cleaning device 20 shown in FIG. 11*a*. The nodular protrusions on sides 21 and 21' preferable protrude farther than the bristle structures 22 and 23 such that the primary structure 19 cups teeth and dentition within the channel of bristles.

The preferred embodiment of the instant invention is particularly useful for guiding and controlling contact positions and angles of the bristle on gums and teeth. The device 20 is also particularly useful for cleaning teeth and gums of persons wearing orthodontia. The device 20 allows bristles to be positioned at angles relative orthodontia that are difficult or impossible to obtain with a conventional toothbrush.

Figure 11C:
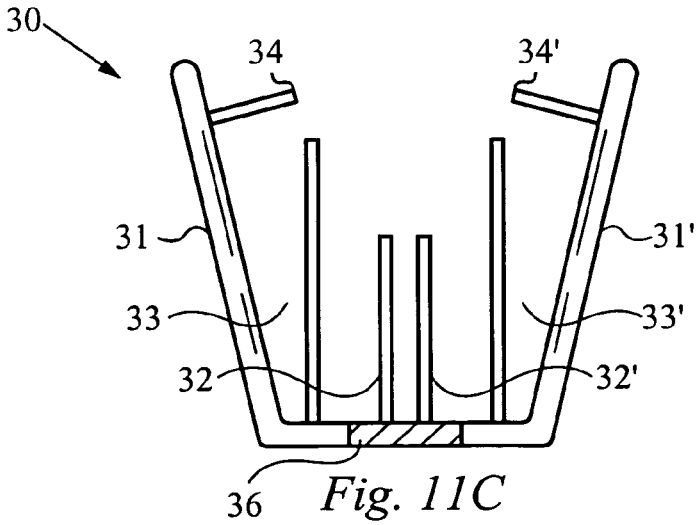

FIG. 11*c* illustrates a cross-sectional view 30 of a contact device in accordance with the instant invention. The L-shaped primary structures 31 and 31' are attached to a support structure 36. The support structure 36 is formed of rigid or flexible materials. The support structure 36 preferably has interspersed flexible segments and rigid segments, as described above and shown in FIG. 11*a*, which allow the support structure 36 to bend and deform as required during use. Protruding from the support structure 36 are bristle structures 32 and 32'. Protruding from inner surfaces of the structures 31 and 31' are bristles structures 33/33' and 34/34', respectively. The flexible backbone structure 36 described is also useful in numerous other devices that are configured to contact and/or clean protruding and/or elongated structures with complex geometries, such as teeth and dentures. In accordance with an embodiment of the invention, the L-shaped primary structures 31 and 31' extended to form a continuous channel or a channel section.

Figure 12A:
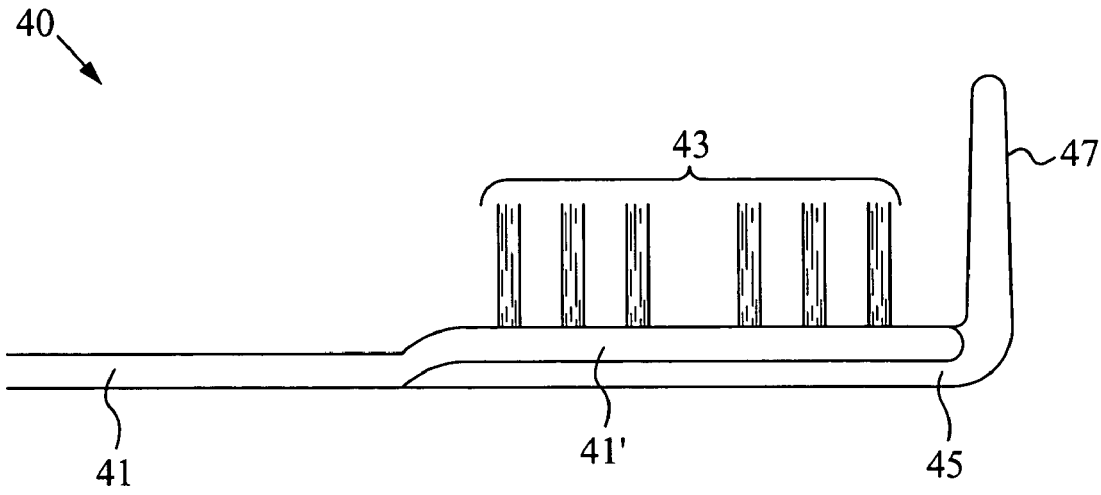
FIGS. 12*a-d* illustrate several views of a dentition cleaning device, in accordance with the further embodiments of the invention.

FIG. 12*a* shows a cross-sectional view of a dentition device 40 in the elongated direction of the dentition device 40. The dentition device 40 includes a handle 41 and support structure 41' that are formed from a first polymeric material. The dentition device 40 preferably includes bristles 43 that protrude the support structure 41'. The dentition device 40 also includes a resilient contact structure 45 (primary structure) that is formed from a second polymeric material. The resilient contact structure 45 preferably includes end nodules and/or squeegees 47 that protrude upward in a direction similar to the bristle 43. The first material that forms the handle 41 and the support structure 41' is preferably a hard semi-rigid polymeric material with a hardness value that is greater than 90 Shores. The second material that forms the resilient contact structure 45 is preferably a softer resilient material with a hardness value that is less than 90 Shores, such that portions of resilient contact structure 45, including the nodules and/or squeegees 47 can be resiliently displaced from the support structure 41', as described in detail above.

Figure 12B:
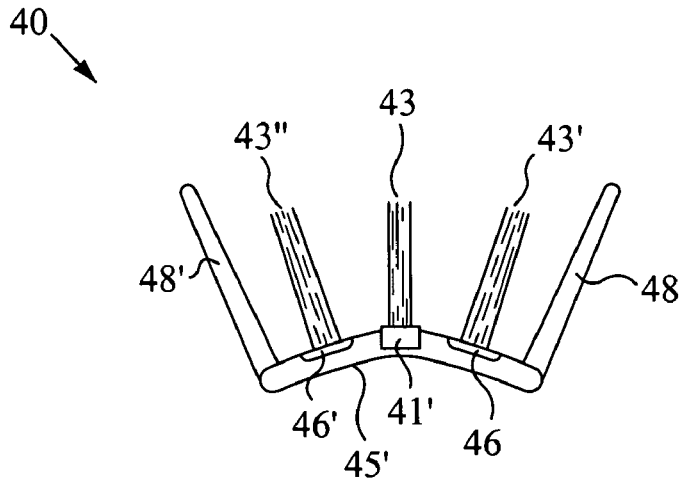

FIG. 12*b* shows a cross-sectional view of the dentition device 40 along the width of the dentition cleaning device 40. The dentition device 40 is shown in FIG. 2*b* with the resilient contact structure 45 and being resilient displaced outward from the support structure 41' along both sides of the dentition device 40. Form the view shown in FIG. 2*b* it can be seen that there are also bristles 43' and 42" that protrude upward from portions of the resilient contact structure 45 and are resiliently displaced from the support structure 41' along with side nodules and/or squeegees 48 and 48'. The bristles 43 and 43' are preferably set onto the resilient contact structure 45 through bristle boat structures 46 and 46' that are formed from the same material as the support structure 41' or a different material that is suitable for securing or anchoring the bristles 43' and 43" to the resilient contact structure 45.

Figure 12C:
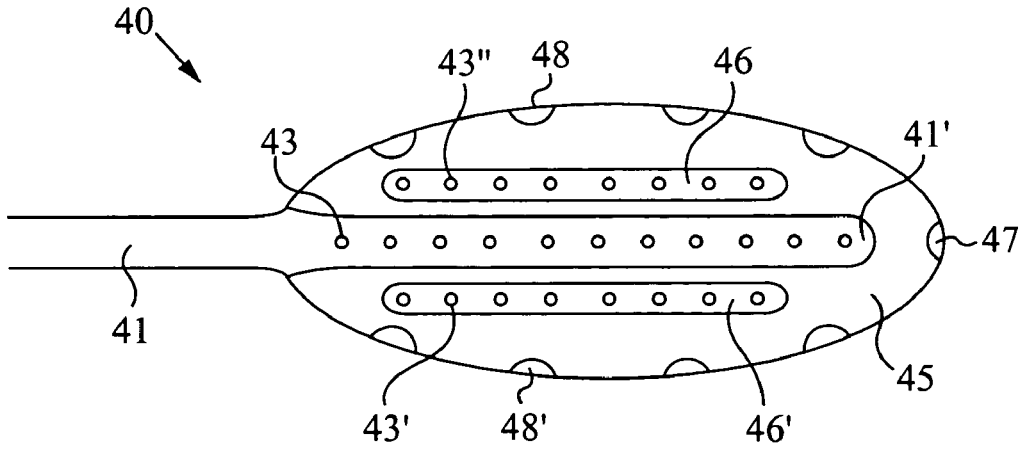
Figure 12D:
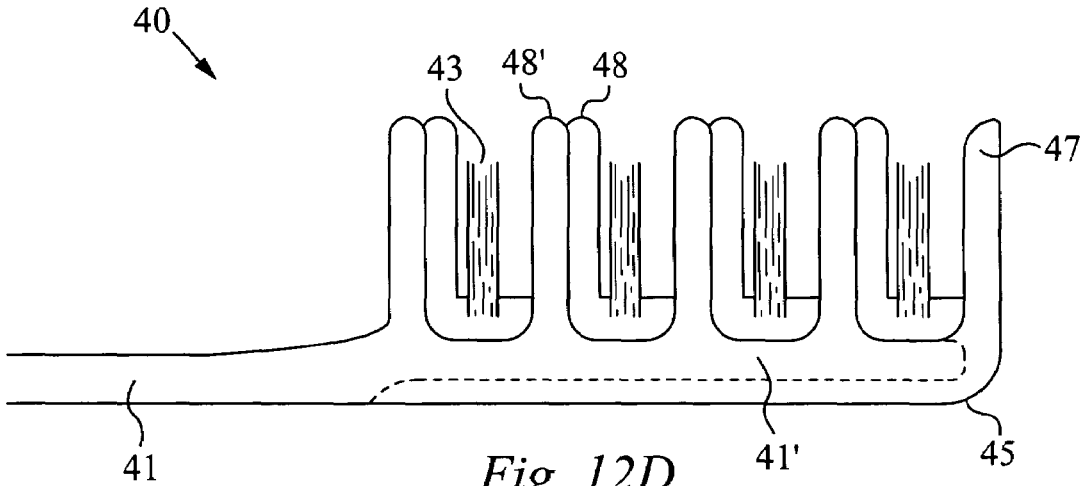

FIG. 12*c* shows a top schematic view of the dentition device that includes the handle 41, the support structure 41', the resilient contact structure 45, the bristle boats 46 and 46', the bristles 43, 43' and 43", the end nodules and/or squeegees 47 and the side nodules and/or squeegees 48' and 48". For completeness, FIG. 12*d* shows a perspective view of the dentition device 40. The bristles 43' and 43" shown in FIGS. 12*a-c* have been removed from FIG. 12*d* for clarity. Note that the support structure 41' is over molded by the resilient contact structure 45, as indicated by the dotted line.

Figure 13A:
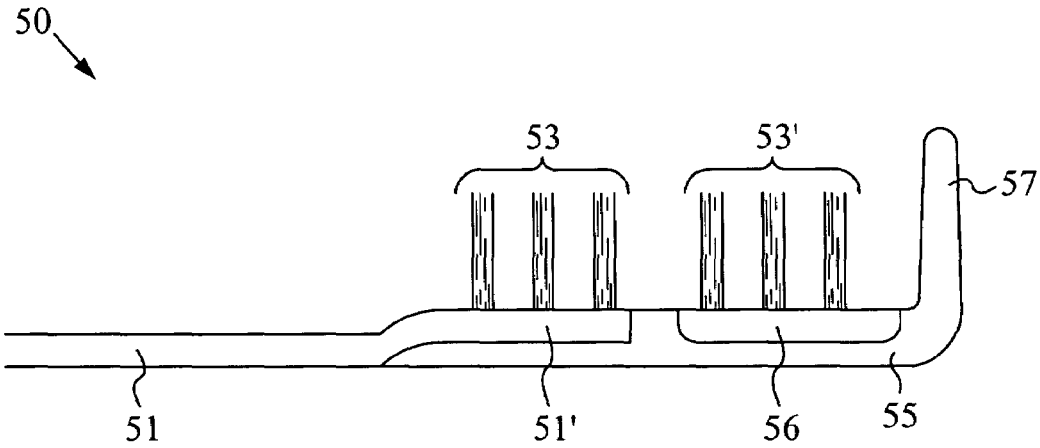
FIGS. 13*a-d* illustrate several views of a dentition cleaning device, in accordance with yet further embodiments of the invention.

FIG. 13*a* shows a cross-sectional view of a dentition device 50 in the elongated direction of the dentition device 50, in accordance with yet further embodiments of the invention. The dentition device 50 includes a handle 51 and support structure 51' that are formed from a first polymeric material. The dentition device 50 preferably includes bristles 53 and 53' that protrude the support structure 51' and a bristle boat 56, respectively. The bristle boat 56 is formed from a material that is suitable for holding and securing the bristles 53', as described above. The dentition device 50 also includes a resilient contact structure 55 that is formed from a second polymeric material. The resilient contact structure 55 preferably includes end nodules and/or squeegees 57 that protrudes upward in a direction similar to the bristle 43. The first material that forms the handle 51 and the primary structure 51' is preferably a hard semi-rigid polymeric material with a hardness value that is greater than 90 Shores. The second material that forms the resilient contact structure 55 is preferably a softer resilient material with a hardness value that is less than 90 Shores, such that portions of resilient contact structure 55, including the end nodules and/or squeegees 57 can be resiliently displaced from the support structure 51'.

Figure 13B:
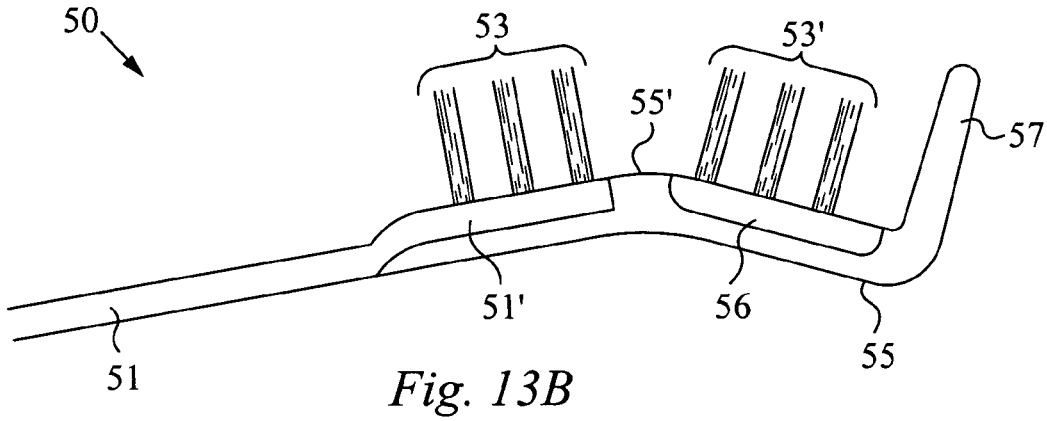

FIG. 13*b* shows the a cross-sectional view of the dentition device 50 in the elongated direction of the dentition device 50 and with the resilient contact structure 55 being resiliently displaced from the support structure 51' through a flexible region 55' of the secondary structure 55. Note that the bristles 53' are displaced in the elongated direction with the with the resilient contact structure 55.

Figure 13C:
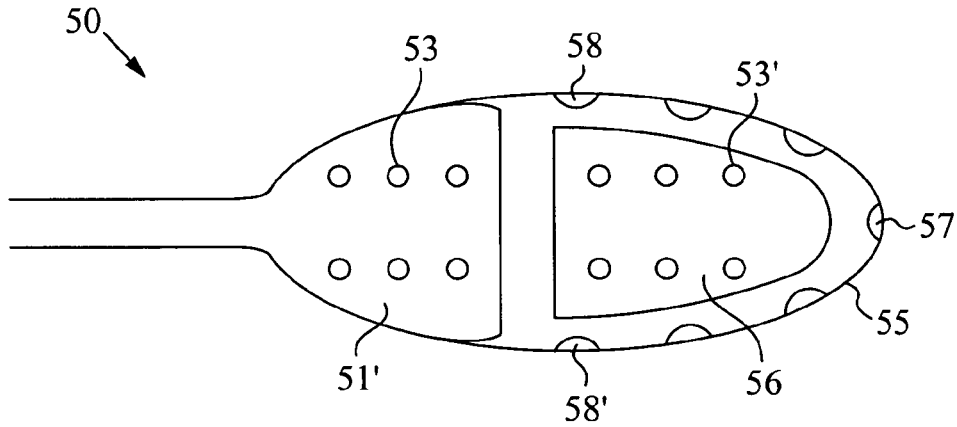
Figure 13D:
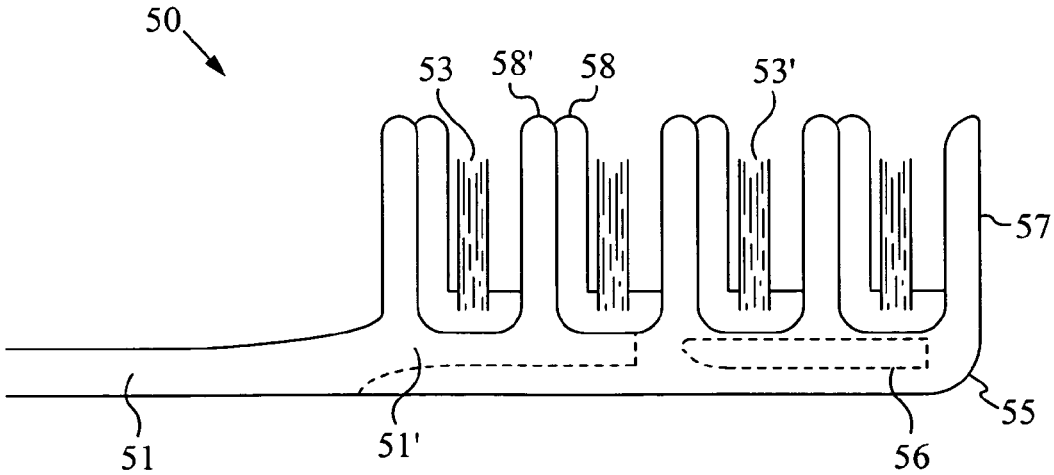

FIG. 13*c* shows a top schematic view of the dentition device 50 that includes the handle 51, the support structure 51', the resilient contact structure 55, the bristle boat 56, the bristles 53 and 53', the end nodules and/or squeegees 57 and the side nodules and/or squeegees 58' and 58". For completeness, FIG. 12*d* shows a perspective view of the dentition device 50. Note that the support structure 51' and the bristle boat 56 are over molded by the resilient contact structure 55, as indicated by the dotted lines.

It will be clear to one skilled in the art that the above embodiment may be altered in many ways without departing from the scope of the invention. Any number of structural geometries, combinations of geometries, materials and combinations of material may be used to configure a device with a multi-structural contact element in accordance with the instant invention. Devices of the instant invention can be configured any number or multi-structural contact elements and configured with handles having any number of shape, sizes and extension angles relative to the multi-structural contact elements. Accordingly, the scope of the invention should be determined by the following claims and their legal equivalents.

What is claimed is:

1. A device comprising; a) a support structure formed from a first material; b) a resilient contact element formed from a second material that is different from the first material and coupled to the support structure, the resilient contact element comprising a base portion protruding outward in a first direction from the support structure and a wall portion protruding upward from the base portion in a second direction to provide top wiping surfaces, wherein the resilient contact element is resiliently coupled to the support structure; and c) bristles coupled to the resilient contact element, the bristles being capable of being cooperatively displaced with the resilient contact element, wherein the bristles are coupled to the resilient contact element through one or more bristle boats.

2. The device of claim 1, wherein a portion of the bristles protrude from the base portion.

3. The device of claim 1, wherein a portion of the bristles protrude from the wall portion.

4. The device of claim 1, wherein the wall portion comprises one or more nodule protrusions and the top wiping surfaces comprise one or more corresponding tips.

5. The device of claim 4, wherein the one or more corresponding tips are curved, angled, pointed or rounded.

6. The device of claim 1, wherein the wall portion comprises one or more squeegee protrusions and the top wiping surfaces comprise one or more corresponding squeegee edges.

7. The device of claim 6, where the one or more corresponding squeegee edges are curved, angled, pointed or rounded.

8. The device of claim 1, wherein the wall portion is tapered.

9. The device of claim 1, wherein the resilient contact element comprises one or more materials selected from the group consisting of silicone, polyurethane, latex, rubber and elastomer.

10. The device of claim 1, wherein the resilient contact element has a hardness in a range of 10 to 90 Shore A.

11. The device of claim 1, further comprising bristle protruding from the support structure.

12. The device of claim 1, wherein the device is a dentition cleaning device.

13. A device comprising: a) a support structure formed from a first material; b) a resilient structure formed from a second material, the resilient structure resiliently coupled to the support structure and comprising a base and walls, wherein the walls taper to form top wiping surfaces; and c) bristles protruding from the resilient structure, wherein the bristles are coupled to the resilient structure through one or more bristle boats.

14. The device of claim 13, wherein a portion of the bristles protrude from the base of the resilient structure.

15. The device of claim 13, wherein a portion of the bristles protrude from the walls of the resilient structure.

16. The device of claim 13, wherein the top wiping surfaces are tips of nodules.

17. The device of claim 16, wherein the tips of the nodules are curved, angled, pointed or rounded.

18. The device of claim 13, wherein the top wiping surfaces are edges of squeegees.

19. The device of claim 18, where the edges of the squeegees are curved, angled, pointed or rounded.

20. The device of claim 13, wherein the resilient structure has a hardness in a range of 10 to 90 Shore A.

21. The device of claim 13, further comprising bristles protruding from the support structure.

22. A device comprising: a) a support structure comprising a first material: b) wiping structures comprising a second material with resilient base portions extending outward in a first direction from the support structure and tapered wall portions extending upward from the resilient base portions in a second direction to form top wiping tips or edges protruding in the second direction; and c) bristles wherein the bristles are coupled to the wiping structures through bristle boats.

23. The device of claim 22, wherein the bristles protrude from the wiping structures.

24. The device of claim 22, wherein the taped wall portions comprise at least one of nodules and squeegees.

25. A device comprising a support structure, one or more wiping structures resiliently coupled to the support structure and have a base extending outward in a first direction from the support structure and walls extending upward from the base in a second direction, wherein the walls terminate in the second direction to form top wiping tips or edges, and bristle coupled to the one or more wiping structures through bristle boats.

* * * * *